US009236011B2

(12) United States Patent
Mizukoshi

(10) Patent No.: US 9,236,011 B2
(45) Date of Patent: Jan. 12, 2016

(54) ORGANIC LIGHT EMITTING DIODE DISPLAY DEVICE FOR PIXEL CURRENT SENSING IN THE SENSING MODE AND PIXEL CURRENT SENSING METHOD THEREOF

(75) Inventor: Seiichi Mizukoshi, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 386 days.

(21) Appl. No.: 13/596,919

(22) Filed: Aug. 28, 2012

(65) Prior Publication Data

US 2013/0050292 A1 Feb. 28, 2013

(30) Foreign Application Priority Data

Aug. 30, 2011 (KR) ..... 10-2011-0087396
Jul. 23, 2012 (KR) ..... 10-2012-0079801

(51) Int. Cl.
*G09G 3/32* (2006.01)

(52) U.S. Cl.
CPC ..... *G09G 3/3291* (2013.01); *G09G 3/3233* (2013.01); *G09G 2300/0866* (2013.01); *G09G 2320/0295* (2013.01); *G09G 2320/043* (2013.01); *G09G 2320/045* (2013.01); *G09G 2320/0693* (2013.01)

(58) Field of Classification Search
CPC ..... G09G 3/2391
USPC ..... 345/690
See application file for complete search history.

(56) References Cited

U.S. PATENT DOCUMENTS 7,838,825 B2 11/2010 Vakhshoori et al.
7,982,695 B2 7/2011 Mizukoshi et al.
8,558,767 B2 10/2013 Kwon
2007/0024543 A1* 2/2007 Chung et al. ..... 345/76
2008/0180365 A1* 7/2008 Ozaki ..... 345/76
2008/0224962 A1* 9/2008 Kasai et al. ..... 345/76
2009/0027376 A1* 1/2009 Kwon ..... 345/214
2009/0027377 A1* 1/2009 Kwon ..... 345/214
2009/0244047 A1* 10/2009 Mizutani et al. ..... 345/211
2011/0063268 A1* 3/2011 Knapp ..... 345/207
2011/0254871 A1* 10/2011 Yoo et al. ..... 345/690
2012/0120041 A1* 5/2012 Kohno et al. ..... 345/211

FOREIGN PATENT DOCUMENTS

CN 1886774 A 12/2006
CN 101261809 A 9/2008
CN 101373578 A 2/2009
KR 10-2010-0047505 A 5/2010

* cited by examiner

*Primary Examiner* — William Boddie
*Assistant Examiner* — Andrew Schnirel
(74) *Attorney, Agent, or Firm* — Birch, Stewart, Kolasch & Birch, LLP

(57) ABSTRACT

An OLED display device which can sense a current of each pixel at high speed by a simple structure in order to compensate for luminance non-uniformity and a pixel current sensing method thereof are discussed. The OLED display device includes a display panel including pixels, each including a light emitting element and a pixel circuit for independently driving the light emitting element, a data driver for driving a data line connected to the pixel circuit using a data voltage, floating one of the data line, a reference line for supplying a reference voltage to the pixel circuit, and a power line for supplying a power to the pixel circuit to use the floated line as a current sensing line, sensing a voltage corresponding to a pixel current of the pixel circuit flowing to the current sensing line, and outputting the sensing voltage, in a sensing mode.

21 Claims, 24 Drawing Sheets

I = Cvdd (V1-V2)/(t2-t1), CVdd=10PF

| Vdata (V) | V1=PL1Voltage (V) @t1 | V2=PL1Volgate(V) @t2 | Calculated current (nA) |
|---|---|---|---|
| 3.0 | 19.8556 | 19.7819 | 36.8210 |
| 4.0 | 19.5953 | 19.3789 | 108.165 |
| 4.5 | 19.4034 | 19.0823 | 160.520 |
| 5.0 | 19.1681 | 18.7191 | 224.498 |

| Vdata (V) | iVdd (nA) @t1 | iVdd (nA) @t2 | Average current (nA) |
|---|---|---|---|
| 3.0 | 36.8720 | 36.7906 | 36.8313 |
| 4.0 | 108.302 | 108.002 | 108.152 |
| 4.5 | 160.763 | 160.197 | 160.480 |
| 5.0 | 225.005 | 224.029 | 224.517 |

ORGANIC LIGHT EMITTING DIODE DISPLAY DEVICE FOR PIXEL CURRENT SENSING IN THE SENSING MODE AND PIXEL CURRENT SENSING METHOD THEREOF

This application claims the benefit of Korean Patent Application No. 10-2011-0087396, filed on Aug. 30, 2011, and Korean Patent Application No. 10-2012-0079801, filed on Jul. 23, 2012,which are hereby incorporated by reference as if fully set forth herein.

BACKGROUND OF THE INVENTION

1. Field of the Invention

The present invention relates to an Active Matrix Organic Light Emitting Diode (AMOLED) display device, and more particularly, to an AMOLED display device which can sense a current of each pixel at high speed by a simple structure in order to compensate for a luminance deviation between pixels and a pixel current sensing method thereof.

2. Discussion of the Related Art

An AMOLED display device is a self-luminous element in which an organic light emitting layer emits light by recombination of electrons and holes and is expected to be used as a future generation display device due to high luminescence, a low driving voltage, and ultra thin thickness.

Each of a plurality of pixels constituting the AMOLED display device includes an Organic Light Emitting Diode (OLED) comprised of an organic light emitting layer between an anode and a cathode and a pixel circuit for independently driving the OLED. The pixel circuit mainly includes a switching Thin Film Transistor (TFT), a capacitor, and a driving TFT. The switching TFT charges a voltage corresponding to a data signal to a capacitor in response to a scan pulse and the driving TFT adjusts the amount of light emission of the OLED by controlling the magnitude of current supplied to the OLED according to the magnitude of the voltage charged in the capacitor. The amount of light emission of the OLED is proportional to current supplied from the driving TFT.

However, in the OLED display device, there is a characteristic difference in a threshold voltage Vth and mobility of the driving TFT between pixels due to a process deviation etc. and thus the amount of current for driving the OLED varies. As a result, a luminance deviation occurs between pixels. Generally, an initially generated characteristic difference of a driving TFT results in spots or patterns on a screen and a characteristic difference caused by degradation of the driving TFT produced while the OLED is driven reduces the lifespan of an AMOLED display panel or generates a residual image.

To solve such a problem, for example, U.S. Pat. No. 7,838,825 discloses a data compensation method for compensating for input data according to a result obtained by sensing a current of each pixel. However, the above patent in which a method for sensing a current flowing to a power line (VDD or VSS) of a panel while lighting up each pixel is used delays a current sensing time due to a parasitic capacitor existing in parallel to the power line when resolution is increased, thereby making it difficult to perform high-speed current sensing.

In addition, although currents of a plurality of pixels can simultaneously sense at high speed using a plurality of current sensing circuits, circuit size is increased and therefore such a method is not practical. Due to this, the above patent can compensate for an initially generated characteristic deviation between driving TFTs by sensing the deviation in a test process prior to product shipment. However, it is difficult to sense and compensate for a characteristic deviation due to degradation of the driving TFT generated while the OLED is driven after product shipment.

SUMMARY OF THE INVENTION

Accordingly, the present invention is directed to a [title] that substantially obviates one or more problems due to limitations and disadvantages of the related art.

An object of the present invention is to provide an OLED display device which can sense a current of each pixel at high speed by a simple structure in order to compensate for a luminance deviation between pixels and a pixel current sensing method thereof.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an OLED for pixel current sensing includes a display panel including pixels, each of the pixels including a light emitting element and a pixel circuit for independently driving the light emitting element; a data driver for driving a data line connected to the pixel circuit using a data voltage, floating one of the data line, a reference line for supplying a reference voltage to the pixel circuit, and a first power line for supplying a power to the pixel circuit in the display panel to use the floated line as a current sensing line, sensing a voltage corresponding to a pixel current of the pixel circuit flowing to the current sensing line, and outputting the sensing voltage, in a sensing mode, wherein the data driver includes a driver for driving the data line and a sensing unit for sensing a voltage of the current sensing line and outputting the sensing voltage.

The driver of the data driver may include a digital-to-analog converter for supplying the data voltage to the data line through an output channel, and the sensing unit of the data driver may include a sampling and holding circuit connected to the output channel in parallel with the digital-to-analog converter, for sampling and holding the voltage of the current sensing line and outputting the sampled and held voltage as the sensing voltage, and an analog-to-digital converter for converting the sensing voltage from the sampling and holding circuit into digital data.

The sensing unit of the data driver may further include a shift register for sequentially outputting sampling signals in the sensing mode and a multiplexer for sequentially outputting multiple outputs of the sampling and holding circuit to the analog-to-digital converter in response to the sampling signals.

The OLED display device may further include a power switch for connecting a second power line connected to a cathode of the light emitting element to a low-potential power or a high-potential voltage, wherein the driver of the data driver further includes a first switch connected between the digital-to-analog converter and the output channel per channel, the sensing unit of the data driver further includes a second switch connected between the output channel and the sampling and holding circuit per channel, the power switch connects the low-potential power to the power line in a display mode and connects the high-potential voltage to the power line in the sensing mode, the first switch connects the digital-to-analog converter to the output channel in the display mode and in a data supply duration of the sensing mode, and the second switch connects the output channel to the sampling and holding circuit in a sensing duration of the sensing mode.

The display panel may further include a third switch connected between the output channel of the data driver and the data line per channel, a fourth switch connected between the output channel and the reference line per channel, and a fifth switch connected between a reference common line for supplying the reference voltage and the reference line per channel, wherein the third switch connects the output channel to the data line in the display mode and in the data supply duration of the sensing mode, the fourth switch connects the output channel to the reference line in the sensing duration of the sensing mode, and the fifth switch connects the reference common line to the reference line in the display mode and in the data supply duration of the sensing mode.

The second, fourth, and fifth switches may be turned on in a precharge duration between the data supply duration and the sensing duration of the sensing mode to precharge the output channel connected to the sampling and holding circuit to the reference voltage supplied from the reference line.

The pixel circuit may include a driving TFT connected serially between the first and second power lines, for driving the light emitting element, a first switching TFT for supplying a data voltage supplied from the data line to a first node connected to a gate electrode of the driving TFT in response to a first scan signal of a first scan line, a second switching TFT for supplying the reference voltage supplied from the reference line to a second node connected between the driving TFT and the light emitting element in response to a second scan signal of a second scan line, and a storage capacitor for charging a voltage between the first and second nodes to supply the changed voltage as a driving voltage of the driving TFT, wherein the first switching TFT is turned on only in the data supply duration of the sensing mode, the second switching TFT is turned on during an interval from the data supply duration to the sensing duration of the sensing mode and the pixel current flows from the driving TFT to the reference line in the sensing duration, and the sensing unit measures a voltage ascending in proportion to the pixel current through the reference line and the output channel in the sensing duration and outputs the sensing voltage.

The pixel circuit may include a driving TFT connected serially between the first and second power lines, for driving the light emitting element, a first switching TFT for supplying the reference voltage supplied from the reference line to a first node connected to a gate electrode of the driving TFT in response to a first scan signal of a first scan line, a second switching TFT for supplying the data voltage supplied from the data line to a second node connected between the driving TFT and the light emitting element in response to a second scan signal of a second scan line, and a storage capacitor for charging a voltage between the first and second nodes to supply the changed voltage as a driving voltage of the driving TFT, wherein the first switching TFT is turned on only in the data supply duration of the sensing mode, the second switching TFT is turned on during an interval from the data supply duration to the sensing duration of the sensing mode and the pixel current flows from the driving TFT to the data line in the sensing duration, and the sensing unit measures a voltage ascending in proportion to the pixel current through the data line and the output channel in the sensing duration.

The first switch may be turned on in a precharge duration between the data supply duration and the sensing duration of the sensing mode to supply a precharge voltage supplied from the digital-to-analog converter to the data line.

In another aspect of the present invention, an OLED display device for pixel current sensing includes, comprising a display panel including pixels, each of the pixels including a light emitting element, a pixel circuit for independently driving the light emitting element, and a data line and a first power line which are connected in parallel with each other and are connected to the pixel circuit; a data driver for supplying a data voltage to the data line in a display mode and a sensing mode; and a sensing unit for supplying a high-potential voltage to the first power line to drive the pixel circuit in the display mode and the sensing mode, cutting off supplying the high-potential voltage to the first power line in a sensing duration of the sensing mode, sensing a voltage corresponding to a pixel current of the pixel circuit using the first power line as a current sensing line, and outputting the sensing voltage.

The sensing unit may include a first switch connected between a high-potential voltage common line for supplying the high-potential voltage and the first power line per channel, and an analog-to-digital converter for sensing a voltage on the first power line and converting the sensing voltage into digital data, wherein the first switch is turned off only in the sensing duration of the sensing mode.

The sensing unit may include a first switch connected between a high-potential voltage common line for supplying the high-potential voltage and the first power line per channel, a sampling and holding circuit connected to the first power line per channel, for sampling and holding a voltage of the first power line in the sensing mode and outputting the sampled and held voltage as the sensing voltage, a shift register for sequentially outputting sampling signals in the sensing mode, a multiplexer for sequentially outputting multiple outputs of the sampling and holding circuit in response to the sampling signals, and an analog-to-digital converter for converting an output voltage of the multiplexer into digital data.

The sensing unit may be integrated with the data driver.

The pixel circuit may include a p-type driving TFT connected serially to the light emitting element between the first and second power lines, for driving the light emitting element, a switching TFT for supplying the data voltage supplied from the data line to a first node connected to a gate electrode of the driving TFT in response to a scan signal of a scan line, and a storage capacitor for charging a voltage between the first node and a second node to which the first power line and the driving TFT are commonly connected to supply the charged voltage as a driving voltage of the driving TFT.

The display panel may further include a reference line for supplying a reference voltage to the pixel circuit, and the pixel circuit may include a driving TFT connected serially to the light emitting element between the first and second power lines, for driving the light emitting element, a first switching TFT for supplying the data voltage supplied from the data line to a first node connected to a gate electrode of the driving TFT in response to a scan signal of a scan line, a second switching TFT for supplying the reference voltage supplied from the reference line to a second node between the driving TFT and the light emitting element in response to a scan signal of the scan line, and a storage capacitor for charging a voltage between the first and second nodes to supply the charged voltage as a driving voltage of the driving TFT.

The display panel may further include a reference line for supplying a reference voltage to the pixel circuit, a high-potential common line for supplying the high-potential voltage, a second switch connected between the high-potential common line and the first power line per channel, for switching connection between the high-potential common line and the first power line in response to a first control signal of a first control line, and a third switch connected between the data line and the first power line per channel, for switching connection between the data line and the first power line in response to a second control signal of a second control line, wherein the sensing unit senses a voltage on the first power line through the data line and the third switch in a sensing duration of the sensing mode and outputs the sensing voltage.

The data driver may include a digital-to-analog converter for supplying the data voltage to the data line through an output channel, a first switch connected between the digital-to-analog converter and the output channel per channel, the sensing unit connected to the output channel in parallel with the digital-to-analog converter, for sensing a voltage on the first power line through the data line and the third switch connected to the output channel and outputting the sensing voltage.

The first switch may be turned on to supply the data voltage supplied from the digital-to-analog converter to the data line through the output channel and the second switch may be turned on to supply the high-potential voltage supplied from the high-potential common line to the first power line, in a data supply duration of the sensing mode, and the first and second switches may be turned off and the third switch may be turned on in the sensing duration of the sensing mode to sense a voltage on the first power line through the data line and the third switch connected to the output channel.

The third switch may be turned on and the first switch may be turned off before the second switch is turned off in the data supply duration and a precharge duration of the sensing mode to precharge the data line and the output channel to the high-potential voltage.

The OLED display device may further include a timing controller for calculating, in the sensing mode, the pixel current using the sensing voltage output from the data driver, the sensing duration, and a capacitance of a capacitor connected in parallel with the current sensing line, calculating a compensation value using the calculated pixel current, and storing the calculated compensation value.

The timing controller may calculate the pixel current (I) through the following Equation 1, using sensing voltages V1 and V2 obtained by sensing voltages on the current sensing line in the data driver, sensing times t1 and t2 of the sensing voltages V1 and V2, and the capacitance C of the capacitor connected in parallel with the current sensing line:

$$I=C\times(V2-V1)/(t2-t1) \quad \text{<Equation 1>}$$

The capacitance may be the sum of a capacitance of a parasitic capacitor existing on the current sensing line and a capacitance of a capacitor connected in parallel with an input terminal of the sensing unit.

The capacitance may be the sum of a capacitance of a parasitic capacitor existing on the first power line and a parasite capacitance existing on the data line.

In still another aspect of the present invention, a method for sensing each pixel current of an OLED display device includes driving a pixel circuit by supplying a data voltage to the pixel circuit in a data supplying duration of a sensing mode; and floating one of a data line connected to the pixel circuit, a reference line, and a first power line to use the floated line as a current sensing line, in a sensing duration of the sensing mode, sensing a voltage corresponding to a pixel current of the pixel circuit flowing to the current sensing line, and outputting the sensing voltage.

In the data supply duration, the data voltage may be supplied to the data line through a first switch connected between a digital-to-analog converter of a data driver and a output channel and through the output channel, and in the sensing duration, a voltage on the current sensing line may be sensed through a second switch which is connected to the output channel in parallel with the first switch in the data driver and performs an opposite operation to the first switch, in the sensing duration, and the sensing voltage may be converted into digital data.

In the data supply duration, the output channel of the data driver may be connected to the data line through a third switch, a fourth switch between the output channel and the reference line may be turned off, and a reference voltage may be supplied to the reference line through a fifth switch, and in the sensing duration, the third and fifth switches may be turned off and the reference line may be connected to the output channel through the fourth switch to sense a voltage corresponding to the pixel current through the reference line.

The method may further include precharging the output channel to the reference voltage supplied from the reference line in a precharge duration between the data supply duration and the sensing duration, wherein the second, fourth, and fifth switches are turned on.

The method may further include sensing a voltage corresponding to the pixel current through the second switch and the data line in the sensing duration, and turning on the first switch and supplying a precharge voltage supplied from the digital-to-analog converter to the data line, in a precharge duration between the data supply duration and the sensing duration.

In a further aspect of the present invention, a method for sensing each pixel current of an OLED display device which includes pixels, each of the pixels including a light emitting element, a pixel circuit for independently driving the light emitting element, and a data line and a first power line which are connected to the pixel circuit and are connected in parallel with each other, includes driving the pixel circuit by supplying a data voltage to the data line and by supplying a high-potential voltage to the first power line, in a data supply duration of a sensing mode; and cutting off supplying the data voltage to the pixel circuit from the data line and simultaneously cutting off supplying the high-potential voltage to the first power line, sensing a voltage corresponding to a pixel current of the pixel circuit using the first power line as a current sensing line, and outputting the sensing voltage in a sensing duration of the sensing mode.

The method may further include turning off a first switch between a high-potential voltage common line for supplying the high-potential voltage and the first power line in the data supply duration, turning off the first switch, sensing a voltage on the first power line, and converting the sensing voltage into digital data, in the sensing duration, and cutting off supplying the data voltage to the pixel circuit from the data line and maintaining supply of the high-potential voltage to the first power line through the first switch, in an interval between the data supply duration and the sensing duration.

A driving TFT of the pixel circuit may be driven using a difference voltage between the data voltage and the high-potential voltage in the data supply duration.

The OLED display device may further include a reference line for supplying a reference voltage to the pixel circuit, and a driving TFT of the pixel circuit may be driven using a difference voltage between the data voltage and the reference voltage in the data supply duration.

The OLED display device may further include a first switch connected between a digital-to-analog converter and an output channel in a data driver, a second switch connected between a high-potential common line for supplying the high-potential voltage and the first power line in a display panel, for switching connection between the high-potential common line and the first power line in response to a first control signal of a first control line, and a third switch connected between the data line and the first power line in the display panel, for switching connection between the data line and the first power line in response to a second control signal of a second control line, wherein the data voltage is supplied to the data line through the first switch and the high-potential voltage is supplied to the first power line through the second switch, in the data supply duration, and the first and second switches are turned off and a voltage on the first power line is sensing through the data line and the third switch, in the sensing duration.

The method may further include turning on the third switch and simultaneously turning off the first switch before the second switch is turned off to precharge the data line and the output channel to the high-potential voltage, in the data supply duration and a precharge duration of the sensing mode.

The method may further include calculating the pixel current using the sensing voltage, the sensing duration, and a capacitance of a capacitor connected in parallel with the current sensing line, calculating a compensation value using the calculated pixel current, and storing the compensation value, in the sensing mode.

The pixel current (I) may be calculated through the above Equation 1, using sensing voltages V1 and V2, sensing times t1 and t2 of the sensing voltages V1 and V2, and a capacitance C of a capacitor connected in parallel with the current sensing line.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 4A and 43 are circuit diagrams illustrating operating states of a sensing mode of the OLED display device illustrated in FIG. 1;

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Figure 1:
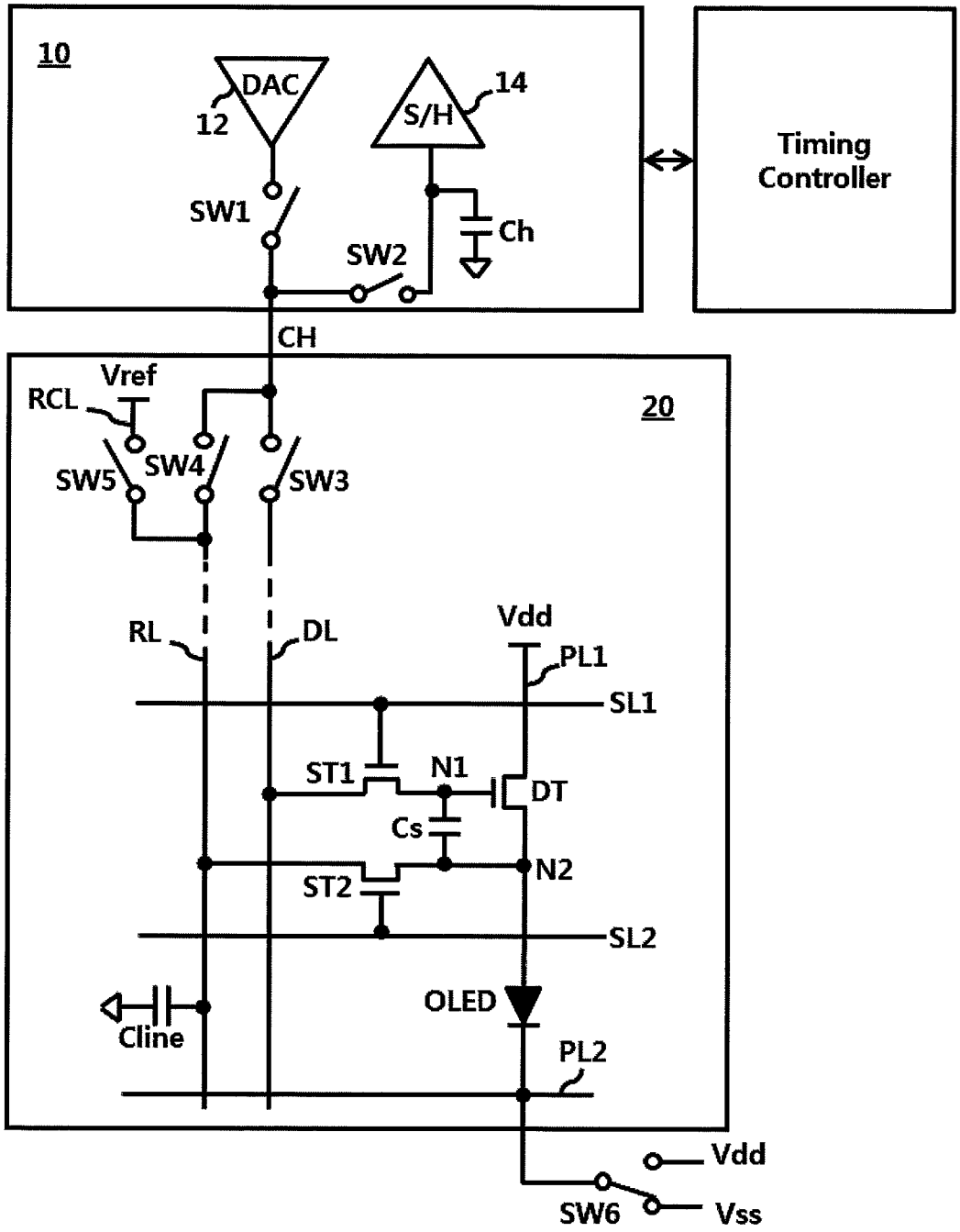
FIG. 1 is a circuit diagram illustrating a partial configuration of an OLED display device for pixel current sensing according to a first exemplary embodiment of the present invention.

FIG. 1 is an equivalent circuit diagram illustrating a partial configuration of an OLED display device for pixel current sensing according to a first exemplary embodiment of the present invention.

The OLED display device illustrated in FIG. 1 includes a display panel 20 in which a pixel array is formed and a data driver 10 for driving a data line DL through an output channel CH connected to the display panel 20, sensing a current of each pixel at high speed, and outputting the sensing current. For convenience of description, the display panel 20 representatively shows the configuration of one pixel and the data driver 10 shows the configuration of a driver connected to the one output channel CH.

Although the OLED display device of the present invention further includes a power supply, a scan driver for driving a scan line SL of the display panel 20, a timing controller for controlling the driving timings of the data driver and scan driver and supplying data to the data driver, the configuration thereof is omitted because they have the same configuration as a conventional configuration.

The OLED display device illustrated in FIG. 1 separately operates as a display mode (FIG. 2) for typical image display and a sensing mode (FIGS. 4A and 4B) for pixel current sensing.

The data driver 10 includes a Digital-to-Analog Converter (DAC) 12 connected to an output channel CHper channel, a Sample and Holding (S/H) circuit 14 connected to the output channel CHper channel, a first switch SW1 connected between the DAC 12 and the output channel CHper channel, a second switch SW2 connected between the output channel CH and the S/H circuit 14 per channel, and a capacitor Ch connected to an input terminal of the S/H circuit 14 per channel.

In the display mode and sensing mode, the DAC 12 converts input data into a data voltage Vdata and supplies the data voltage Vdata to the data line DL of the display panel 20 through the first switch SW1 and the output channel CH. In the sensing mode, the S/H circuit 14 measures (samples and holds) a voltage of a current sensing line (reference line or data line) of the display panel 20 through the output channel CH and the second switch SW2 and outputs the sensing voltage.

Each pixel of the display panel 20 includes an OLED and a pixel circuit for independently driving the OLED. The pixel circuit includes at least three Thin Film Transistors (TFTs) ST1, ST2, and DT, one storage capacitor Cs, a first power line PL1 for supplying a high-potential voltage Vdd, a second power line PL2 for supplying the high-potential voltage Vdd or a low-potential voltage Vss which is lower than the high-potential voltage Vdd, a reference line RL for supplying a reference voltage Vref which is lower than the high-potential voltage Vdd and higher than the low-potential voltage Vss, first and second scan lines SL1 and SL2 for supplying first and second scan signals, respectively, and the data line DL for supplying the data voltage Vdata. The reference line RL is formed in parallel with the data line DL. The number of reference lines RL is the same as the number of data lines DLs which equals the number of pixel columns.

The display panel 20 includes a third switch SW3 connected between the output channel CH and the data line DLper channel, a fourth switch SW4 connected between the output channel CH and the reference line RL per channel, and a fifth switch SW5 connected between a reference common line RCL for supplying the reference voltage Vref from an external voltage source and the reference line RL.

In addition, the OLED display device further includes a sixth switch SW6 for switching the high-potential voltage Vdd or the low-potential voltage Vss to the second power line PL2. The sixth switch SW6 may be connected to a power supply or may be connected to the power supply and the display panel 20. The sixth switch SW6 connects the low-potential voltage Vss to the second power line PL2 in the display mode and connects the high-potential voltage Vdd to the second power line PL2 in the sensing mode.

Control signals for controlling the first to sixth switches SW1 to SW6 are generated from the timing controller or the data driver 10 and are supplied to the first to sixth switches SW1 to SW6.

The OLED is serially connected to the driving TFT DT between the first power line PL1 and the second power line PL2. The OLED includes an anode connected to the driving TFT DT, a cathode connected to the second power line PL2, and a light emitting layer between the anode and the cathode. The light emitting layer includes an electron injection layer, an electron transport layer, an organic light emitting layer, a hole transport layer, and a hole injection layer, which are sequentially deposited between the cathode and the anode. If a positive bias is supplied between the anode and the cathode, electrons are supplied from the cathode to the organic light emitting layer via the electron injection layer and the electron transport layer and holes are supplied from the anode to the organic light emitting layer via the hole injection layer and hole transport layer. Then, the supplied electrons and holes recombine in the organic light emitting layer to cause radiate fluorescent or phosphorescent material to emit light and thus to generate luminescence proportional to current density.

The first switching TFT ST1 has a gate electrode connected to the first scan line SL1, a first electrode connected to the data line DL, and a second electrode connected to a first node N1 connected to a gate electrode of the driving TFT DT. The first electrode and second electrode of the first switching TFT ST1 may be a source electrode and a drain electrode according to a current direction. In the display mode and sensing mode, the first switching TFT ST1 supplies the data voltage Vdata from the data line DL to the first node N1 in response to a scan signal of the first scan line SL1.

The second switching TFT ST2 has a gate electrode connected to the second scan line SL2, a first electrode connected to the reference line RL, and a second electrode connected to a second node N2 connected to a second electrode of the driving TFT DT. The first electrode and second electrode of the second switching TFT ST2 may be a source electrode and a drain electrode according to a current direction. In the display mode and sensing mode, the second switching TFT ST2 supplies the reference voltage Vref from the reference line RL to the second node N2 in response to a scan signal of the second scan line SL2. Moreover, in the sensing mode, the second switching TFT ST2 supplies current from the driving TFT DT, i.e. a pixel current, to the reference line RL in response to the scan signal of the second scan line SL2.

The storage capacitor Cs charges a difference voltage Vdata−Vref between the data voltage Vdata and the reference voltage Vref supplied respectively to the first node N1 and the second node N2 and supplies the difference voltage as a driving voltage Vgs of the driving TFT DT.

The driving TFT DT has a gate electrode connected to the first node N1, a first electrode connected to the first power line PL1, and a second electrode connected to the second node N2. The first electrode and the second electrode of the driving TFT DT are a source electrode and a drain electrode according to a current direction. The driving TFT DT causes the OLED to emit light by supplying a pixel current corresponding to the driving voltage Vgs supplied from the storage capacitor Cs to the OLED.

Figure 2:
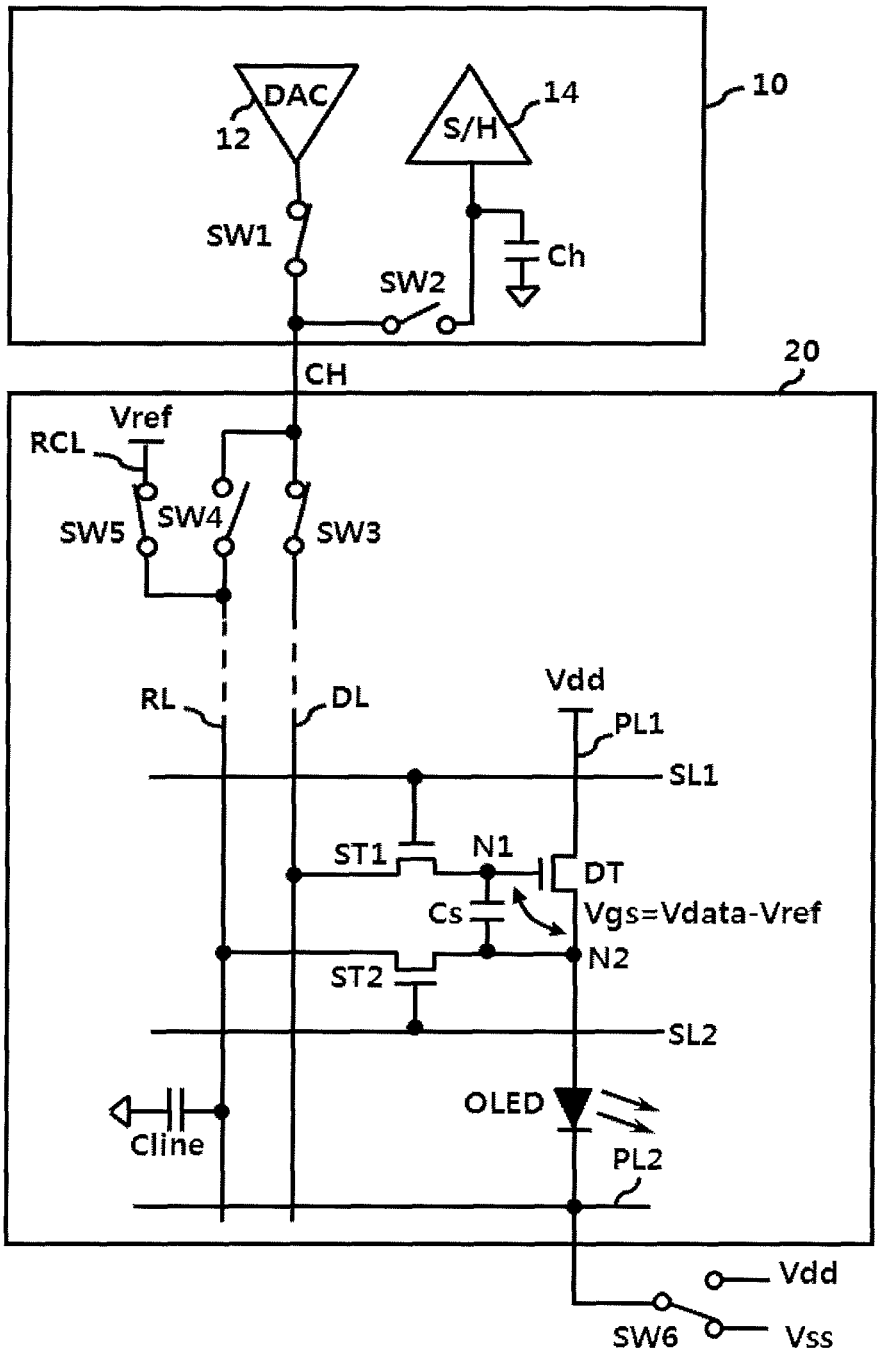
FIG. 2 is a circuit diagram illustrating an operating state of a display mode of the OLED display device illustrated in FIG. 1.
Figure 3:
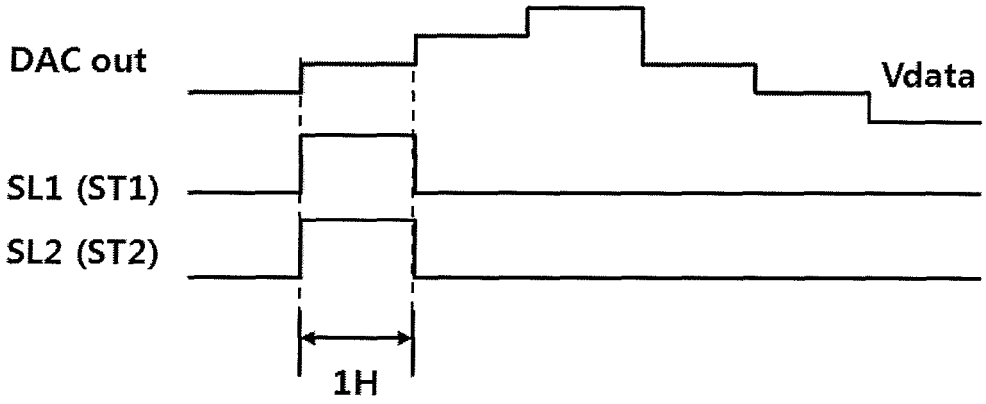
FIG. 3 is a driving waveform chart of a display mode of the OLED display device illustrated in FIG. 2.

FIG. 2 illustrates an operating state of a display mode of the OLED display device illustrated in FIG. 1. FIG. 3 is a driving waveform chart of one pixel circuit illustrated in FIG. 2.

In the display mode shown in FIG. 2, the first and third switches SW1 and SW3 connected serially between the DAC 12 and the data line DL and the fifth switch SW5 connected between the reference common line RCL and the reference line RL are always turned on in response to corresponding control signals. On the other hand, the second switch SW2 connected between the output channel CH and the S/H circuit 14 and the fourth switch SW4 connected between the output channel CH and the reference line RL are always turned off in response to corresponding control signals. The sixth switch SW6 connects the low-potential voltage Vss to the second power line PL2 in response to a corresponding control signal.

In a scan duration 1H of the display mode shown in FIG. 2, the DAC 12 converts input digital data into an analog data voltage Vdata and the data voltage Vdata is supplied to the data line DL through the first and third switches SW1 and SW3. The reference voltage Vref from the reference common line RCL is supplied to the reference line RL through the fifth switch SW5. If the first and second TFTs ST1 and ST2 of the pixel circuit are simultaneously turned on in response to the first and second scan signals of the first and second scan lines SL1 and SL2, respectively, the storage capacitor Cs charges the difference voltage (Vdata−Vref) between the data voltage Vdata and the reference voltage Vref and supplies the difference voltage as the driving voltage Vgs of the driving TFT DT. Even if the first and second TFTs ST1 and ST2 of the pixel circuit are simultaneously turned off in response to the first and second scan signals, the storage capacitor Cs supplies the charging voltage Vdata−Vref as the driving voltage Vgs of the driving TFT DT. Accordingly, the OLED emits light in proportion to a current corresponding to the driving voltage Vgs of the driving TFT DT.

Figure 4A:
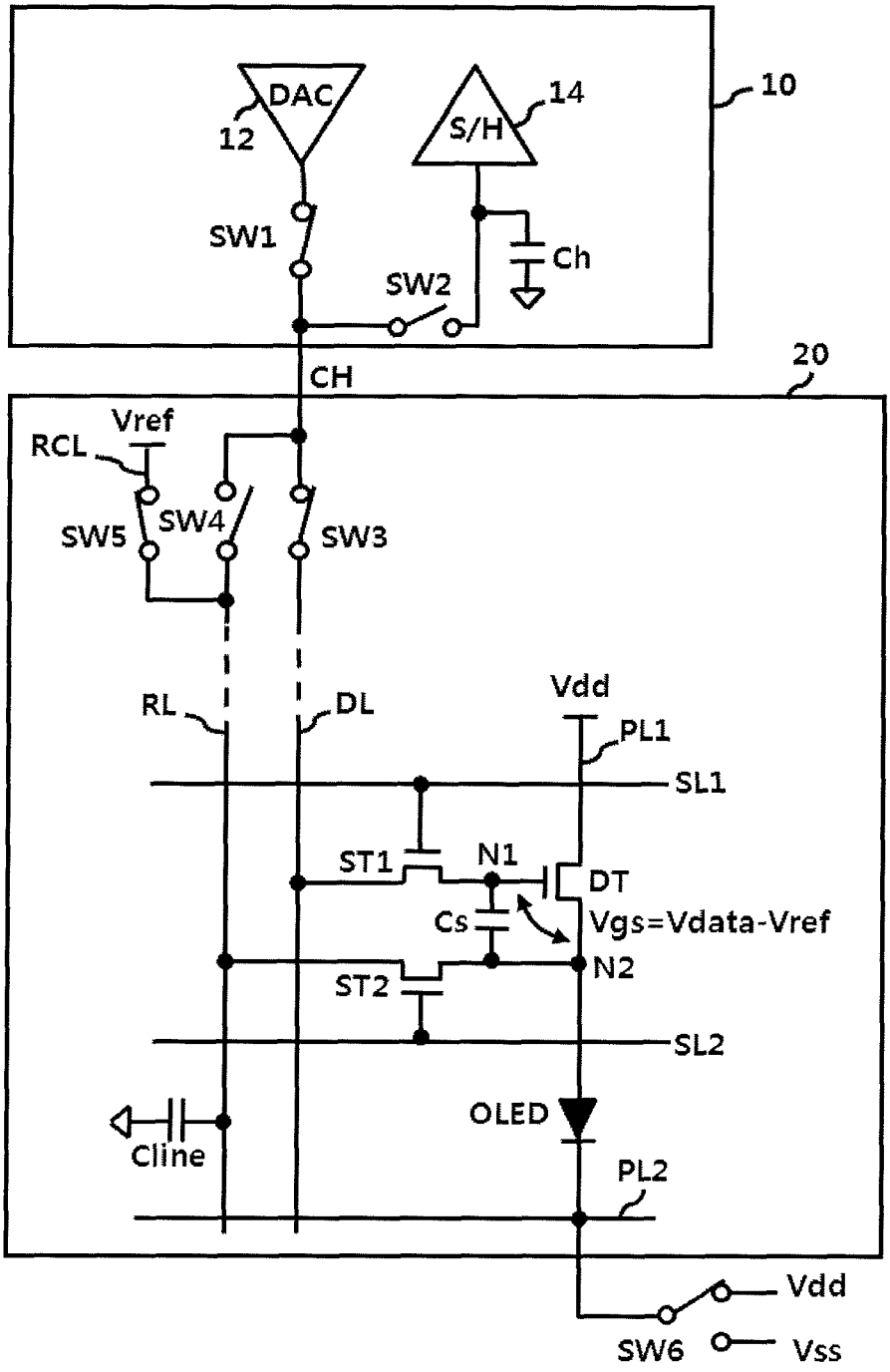
Figure 4B:
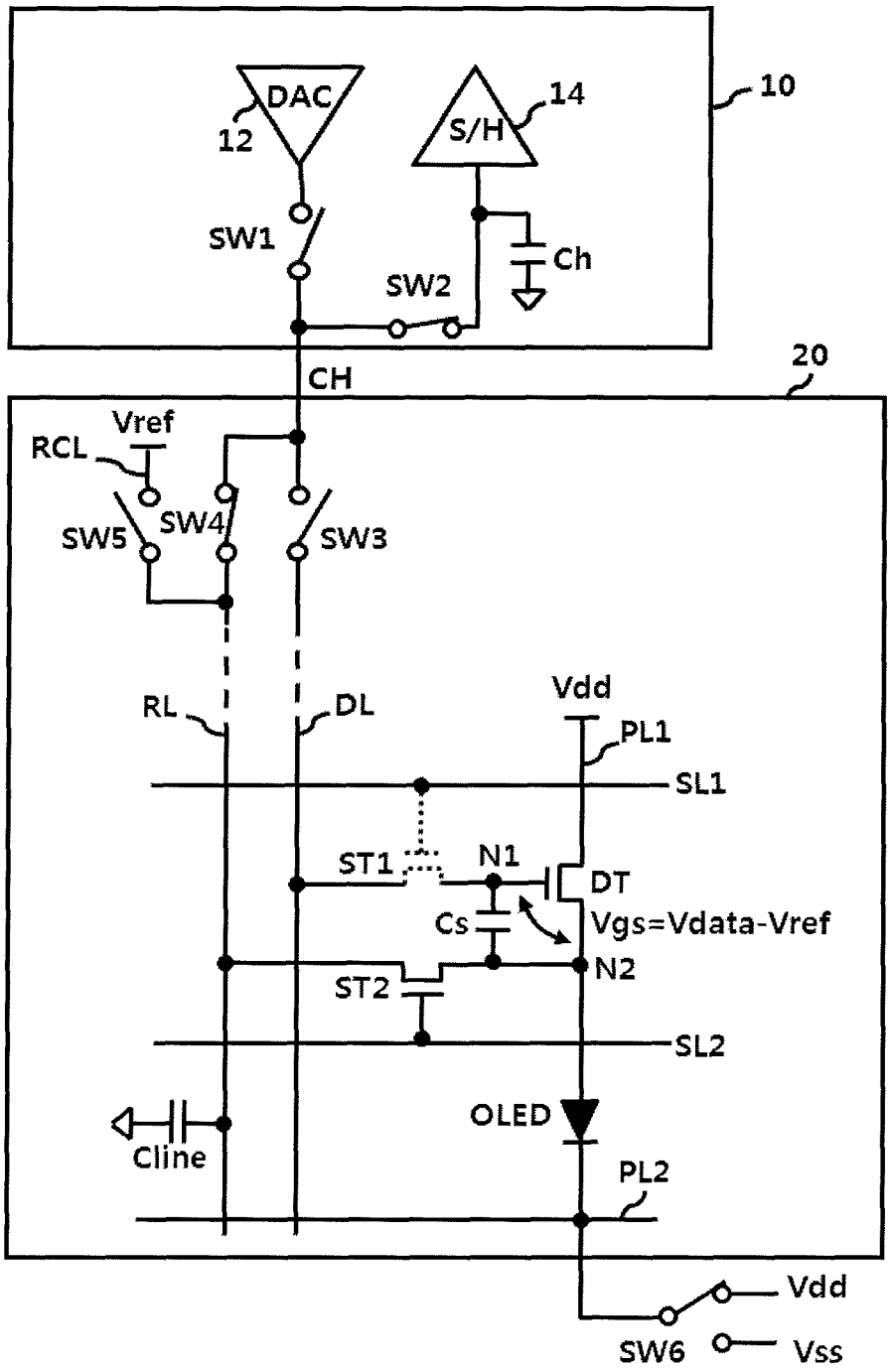
Figure 5:
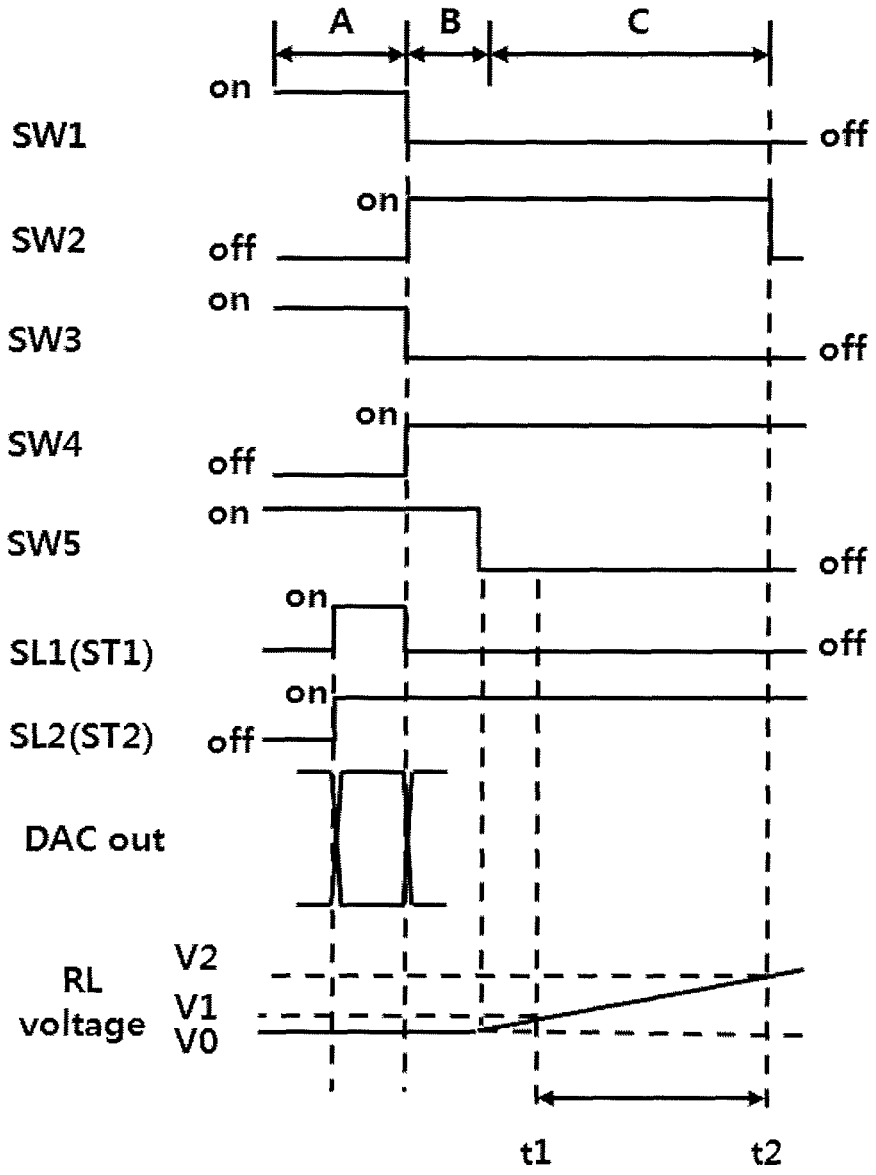
FIG. 5 is a driving waveform chart of a sensing mode of the OLED display device illustrated in FIGS. 4A and 4B.

FIGS. 4A and 4B are circuit diagrams illustrating operating states of a sensing mode of the OLED display device illustrated in FIG. 1 in stages. FIG. 5 is a driving waveform chart of the sensing mode of the OLED display device illustrated in FIGS. 4A and 4B.

In a data supply duration A of the sensing mode shown in FIGS. 4A and 5, the first and third switches SW1 and SW3 connected between the DAC 12 and the data line DL and the fifth switch SW5 connected between the reference common line RCL and the reference line RL are turned on and the second switch SW2 connected between the output channel CH and the S/H circuit 14 and the fourth switch SW4 connected between the output channel CH and the reference line RL are turned off. In this case, the sixth switch SW6 connects the high-potential voltage Vdd to the second power line PL2 in response to a corresponding control signal. The DAC 12 converts sensing input data into a data voltage and supplies the data voltage to the data line DL via the first and third switches SW1 and SW3. The reference voltage Vref (=V0) is supplied to the reference line RL through the fifth switch SW5. The first and second switching TFTs ST1 and ST2 of the pixel circuit are simultaneously turned on in response to the first and second scan signals and supply the sensing data voltage Vdata and the reference voltage Vref to the first and second nodes N1 and N2, respectively. Then, the storage capacitor Cs charges the difference voltage Vdata−Vref between the sensing data voltage Vdata and the reference voltage Vref to drive the driving TFT DT. At this time, since a negative bias is applied to the OLED, the OLED does not emit light.

Next, in a precharge duration B of the sensing mode shown in FIG. 5, the first and third switches SW1 and SW3 connected between the DAC 12 and the data line DL are turned off in response to corresponding control signals and the second switch SW2 connected between the output channel CH and the S/H circuit 14 and the fourth switch SW4 connected between the output channel CH and the reference line RL are turned on. The first switching TFT ST1 is turned off in response to the scan signal of the first scan line SL1. In this case, the fifth switch SW5 connected between the reference common line RCL and the reference line RL maintains the turned-on state. Then the output channel CH connected to the reference line RL is precharged to the reference voltage Vref.

Figure 6:
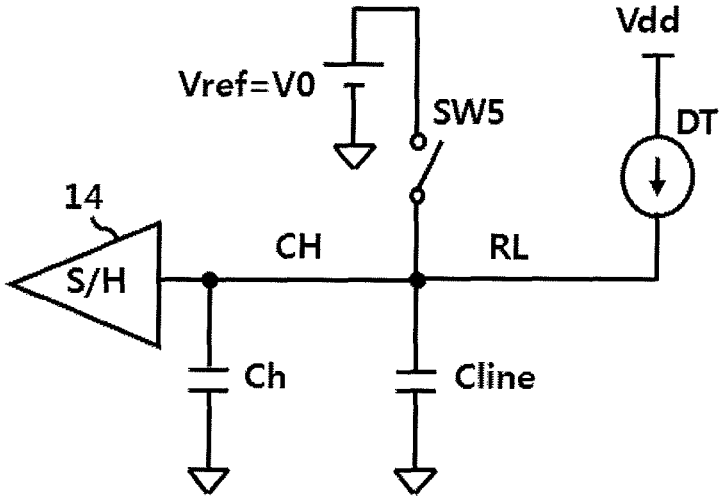
FIG. 6 is an equivalent circuit diagram of a sensing mode of the OLED display device illustrated in FIG. 4B.

In a sensing duration C shown in FIGS. 4B and 5, the fifth switch SW5 connected between the reference common line RCL and the reference line RL is turned off in response to a corresponding control signal. Then, a pixel current flowing through the driving TFT DT of the pixel circuit flows to a parasitic capacitor Cline connected in parallel with the reference line RL and to the capacitor Ch via the reference line RL and thus a voltage of the reference line RL is raised from the reference voltage Vref (=V0). FIG. 6 illustrates an equivalent circuit for a path along which the pixel current flow in the sensing duration C shown in FIG. 4B. If the fifth switch SW5 is turned off, the pixel current flowing though the driving TFT DT flows to the S/H circuit 14 through the reference line RL and thus the parasitic capacitor Cline and the capacitor Ch are charged to raise the voltage of the reference line RL.

At this time, since the voltage of the reference line RL is raised in proportion to the pixel current, the pixel current flowing to the driving TFT DT can be calculated using the following Equation 1 by turning off the second switch SW2 at a specific time and reading the voltage of the reference line RL from the S/H circuit 14.

$$I=(Cline+Ch)\times(V2-V1)/(t2-t1) \quad \text{<Equation 1>}$$

In Equation 1, I denotes a pixel current, Cline denotes the capacitance of the parasitic capacitor connected in parallel with the reference line RL, Ch denotes the capacitance of the capacitor connected in parallel with the input terminal of the S/H circuit 14, and V1 and V2 denote voltages of the reference line RL detected at times t1 and t2 in the duration C of the sensing mode shown in FIG. 5. For example, assuming that the capacitance Cline+Chof the capacitors is 50 pF, a voltage variation V2−V1 is 1V, and a time (t2−t1) is 100 μs, it can be appreciated that the pixel current I calculated using Equation 1 is 500 nA.

Meanwhile, if a charge start voltage of the reference line RL is a base voltage V0, the pixel current I can be obtained using the following Equation 2 by sensing the voltage of the reference line RL at a time t2 only once.

$$I=(Cline+Ch>\times(V2-V0)/(t2-t0) \quad \text{<Equation 2>}$$

Thus, the data driver 10 measures a voltage corresponding to each pixel current through the reference line RL in the sensing mode, converts the sensing voltage into digital data, and supplies the digital data to the timing controller.

The timing controller compensates for data by detecting a characteristic deviation according to the pixel current of the driving TFT DT using the sensing voltage of each pixel from the data driver 10 in the sensing mode. In other words, the timing controller detects a compensation value for compensating for a threshold voltage of the driving TFT DT and a mobility deviation according to the current of each pixel using the sensing voltage supplied from the data driver 10 as digital data in the sensing mode and stores the compensation value in a memory. The timing controller compensates for input data in a display mode using the compensation value stored in the sensing mode.

For example, the timing controller calculates the pixel current of the driving TFT DT of each pixel as indicated by Equation 1 or Equation 2 using the sensing voltage from the data driver 10 in the sensing mode. As disclosed in U.S. Pat. No. 7,982,695, the timing controller detects a threshold voltage indicating the characteristic of the driving TFT DT and a mobility deviation between pixels (ratio of mobility between a corresponding pixel and a reference pixel) using a function for calculating a pixel current according to the threshold voltage and mobility, detects an offset value for compensating for the detected threshold value and a gain value for compensating for the mobility deviation as compensation values, and stores the compensation values in a memory in the form of a look-up table. The timing controller compensates for input data in the display mode using the stored offset value and gain value of each pixel. For example the timing controller compensates for the input data by multiplying the gain value by an input data voltage and adding the offset value to the input data voltage.

In this way, the OLED display device according to the present invention drives the data line DL using the data driver in the sensing mode and can simply sense each pixel current at high speed through the reference line RL. The OLED display device measures each pixel current by including the sensing mode in the display mode in which the OLED display device is driven even after product shipment as well as a test process before product shipment, thereby compensating for a characteristic deviation caused by degradation of the driving TFT. In addition, in the OLED display device according to the present invention, since each output channel of the data driver is sequentially connected to the data line DL and the reference line RL in the sensing mode, the data driver can prevent the number of output channels of the data driver from increasing while sensing the pixel current through the reference line RL.

Figure 7:
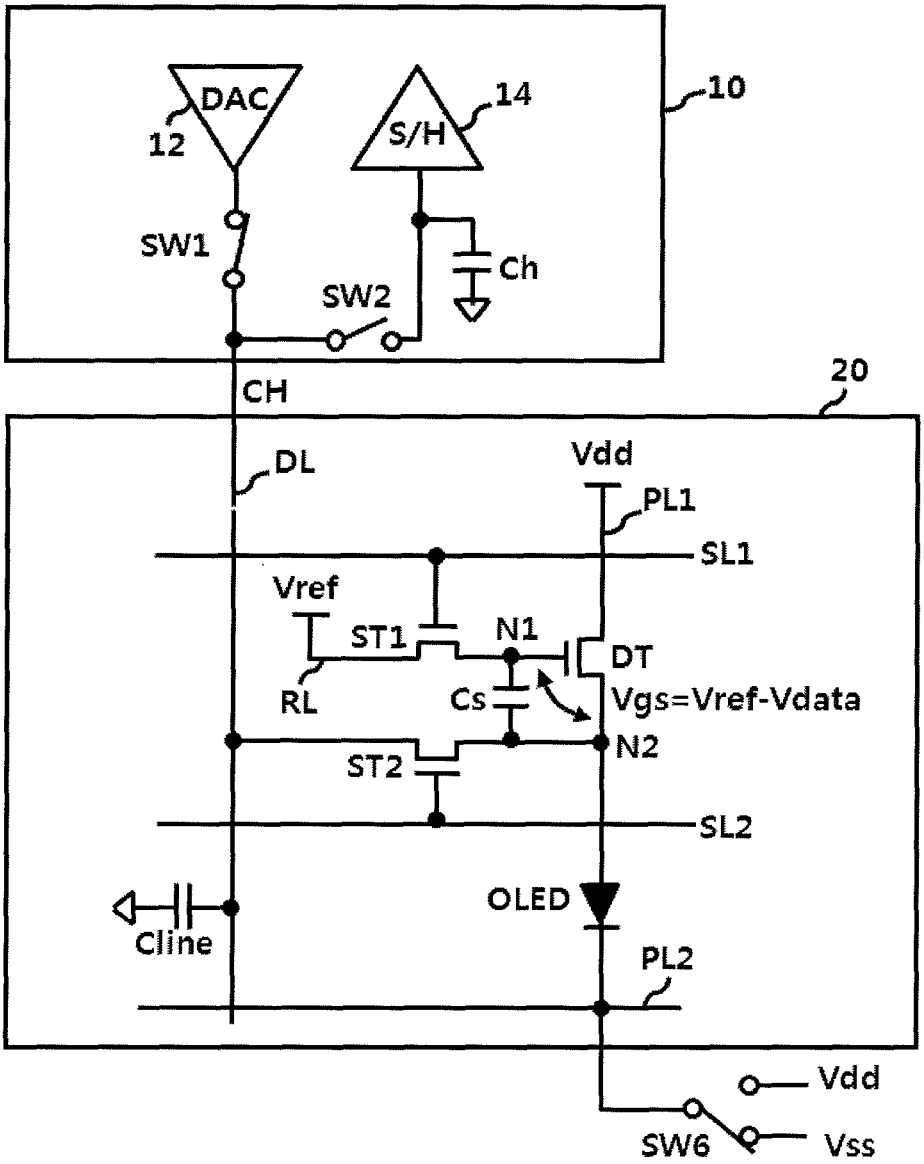
FIG. 7 is a circuit diagram illustrating an operating state of a display mode of an OLED display device for pixel current sensing according to a second exemplary embodiment of the present invention.
Figure 8:
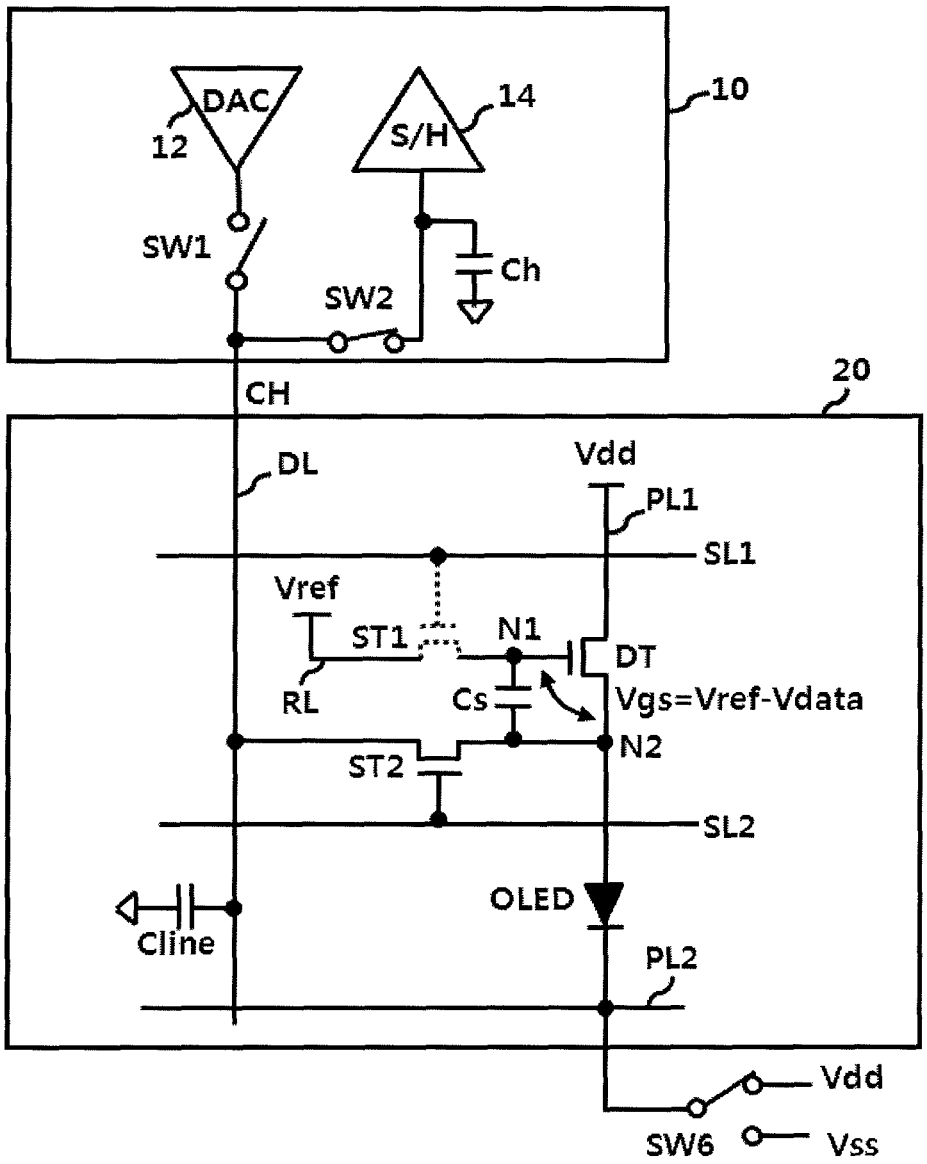
FIG. 8 is a circuit diagram illustrating an operating state of a sensing mode of an OLED display device for pixel current sensing according to a second exemplary embodiment of the present invention.
Figure 9:
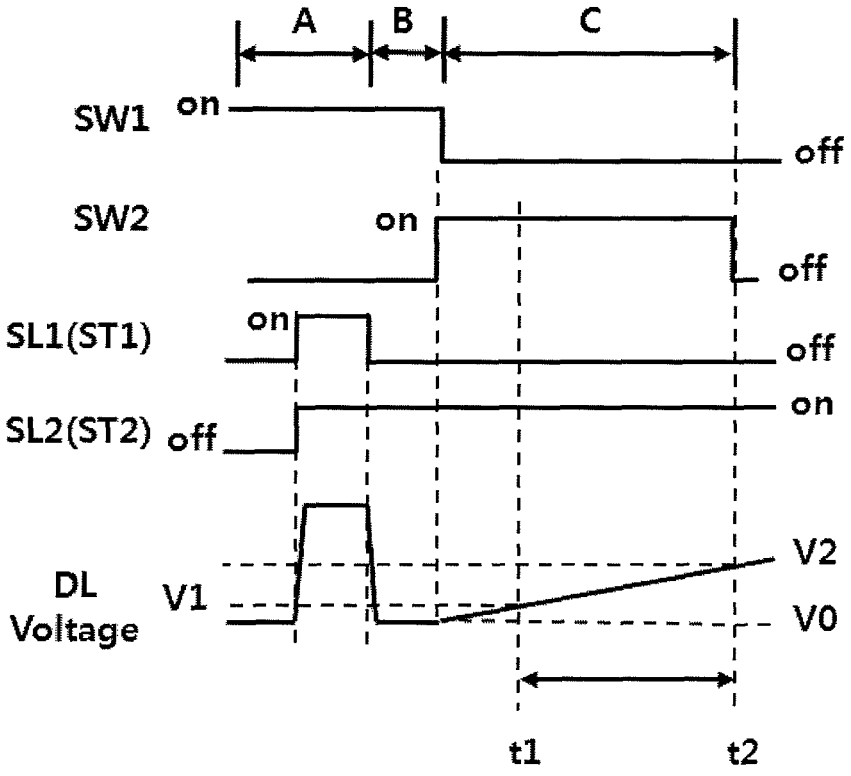
FIG. 9 is a driving waveform chart of a sensing mode of the OLED display device illustrated in FIG. 8.

FIGS. 7 and 8 are circuit diagrams respectively illustrating operating states in a display mode and a sensing mode of an OLED display device for pixel current sensing according to a second exemplary embodiment of the present invention. FIG. 9 is a driving waveform chart of the sensing mode of the OLED display device illustrated in FIG. 8.

The OLED display devices of the second exemplary embodiment illustrated in FIGS. 7 and 8 have the same configuration as the OLED display device of the first exemplary embodiment illustrated in FIG. 1 except that the third to fifth switches SW3, SW4, and SW5 in the display panel 20 in FIG. 1 are omitted, the first switching TFT ST1 in the pixel circuit supplies the reference voltage Vref to the first node N1, and the second switching TFT ST2 supplies the data voltage Vdata to the second node N2. Therefore, a description of repeated elements will be omitted. The DAC 12 and the S/H circuit 14 of the data driver 10 are connected to the data line DL of the display panel 20 through the output channel CH.

In each scan duration of the display mode shown in FIG. 7, the storage capacitor Cs charges the difference voltage (Vref−Vdata) between the reference voltage Vref from the turned-on first switching TFT ST1 and the data voltage Vdata from the turned-on second switching TFT ST2 to drive the driving TFT DT. Even when the first and second switching TFTs ST1 and ST2 are turned off, the driving TFT DT is driven by the driving voltage (Vgs=Vref−Vdata) from the storage capacitor Cs. Accordingly, the driving TFT DT supplies current corresponding to the driving voltage Vgs to the OLED and the OLED emits light.

Referring to FIGS. 8 and 9, in a data supply duration A of the sensing mode, the first switch SW1 between the DAC 12 and the data line DL is turned on and the second switch SW2 connected between the data line DL and the S/H circuit 14 is turned off, in response to corresponding control signals, and the sixth switch SW6 connects the high-potential voltage Vdd to the second power line PL2 in response to a corresponding control signal (not shown). The DAC 12 supplies the sensing data voltage Vdata to the data line DL via the first switch SW1. Since the first and second switching TFTs ST1 and ST2 of the pixel circuit supply the reference voltage Vref and the sensing data voltage Vdata to the first and second nodes N1 and N2 in response to first and second scan signals, respectively, the driving TFT DT is driven according to the voltage Vref-Vdata stored in the storage capacitor Cs. In this case, since a negative bias is supplied to the OLED, the OLED does not emit light.

Next, in a precharge duration B of the sensing mode shown in FIG. 9, the first switching TFT ST1 is turned off in response to a scan signal of the first scan line SL1 and the DAC 12 precharges a precharge voltage V0 to the data line DL by supplying a precharge voltage V0 (=Vref) through the first switch SW1. The DAC 12 generates the precharge voltage V0 during an interval except for the data supply duration A.

In a sensing duration C shown in FIGS. 8 and 9, the first switch SW1 is turned off and the second switch SW2 is turned on, in response to corresponding control signals. Then, a pixel current flowing through the driving TFT DT of the pixel circuit flows to the parasitic capacitor Cline and the capacitor Ch connected in parallel with the data line DL via the data line DL and a voltage of the data line DL is raised from the base voltage V0 as shown in FIG. 9. In this case, since the voltage of the data line DL is raised in proportion to the pixel current, the pixel current I flowing to the driving TFT DT can be calculated using the above Equation 1 or Equation 2 by turning off the second switch SW2 of the S/H circuit 14 at a specific time and reading the voltage of the data line DL held at the capacitor Ch through the ADC 16.

Figure 10:
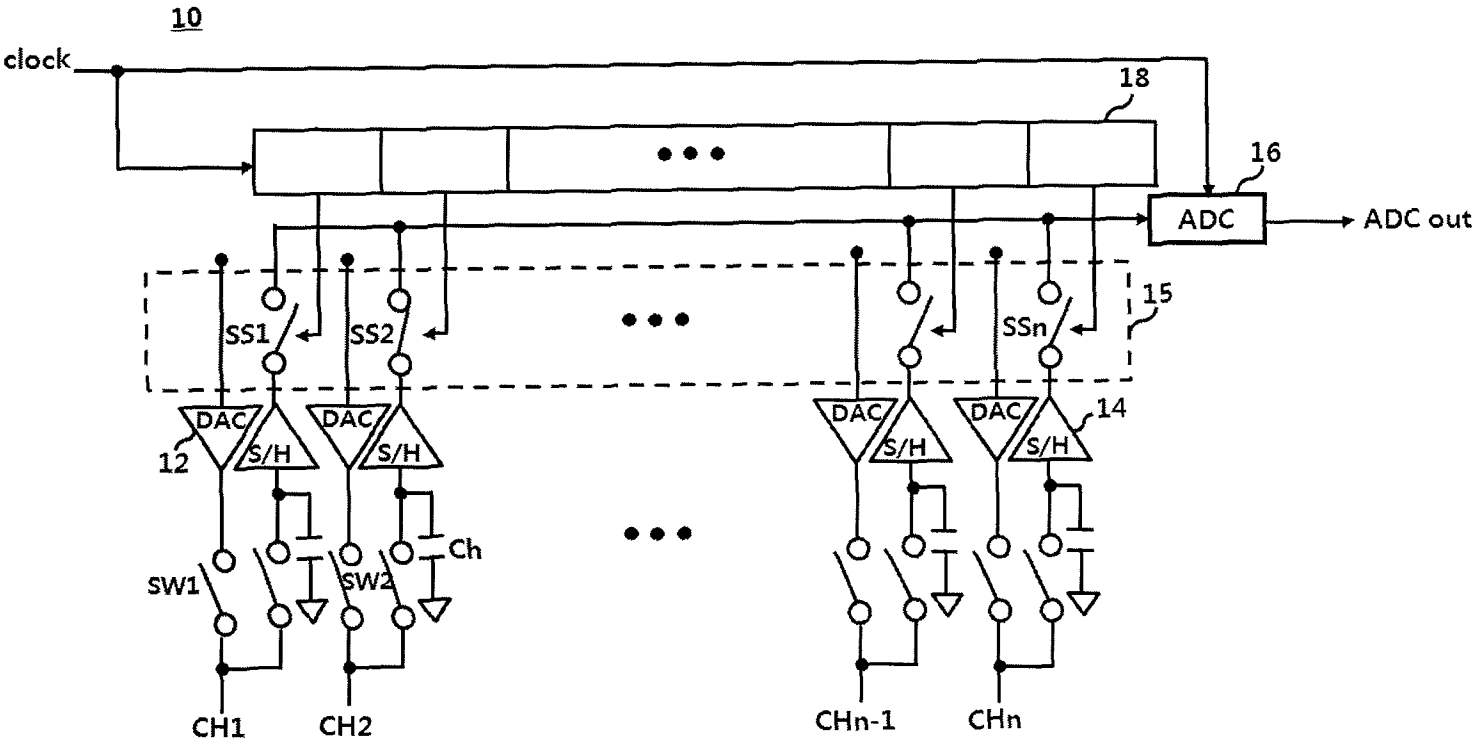
FIG. 10 is a block diagram illustrating the internal configuration of a data driver according to an exemplary embodiment of the present invention.

FIG. 10 is a block diagram illustrating a detailed configuration of a data driver according to an exemplary embodiment of the present invention.

The data driver 10 illustrated in FIG. 10 includes a shift register 18, n DACs 12 connected to n output channels CH1 to CHn per channel, n S/H circuits 14 connected to the n output channels CH1 to CHn per channel, n first switches SW1 connected between the n DACs 12 and the n output channels CH1 to CHn per channel, n second switches SW2 connected between the n output channels CH1 to CHn and the n S/H circuits 14 per channel, n capacitors Ch connected in parallel to input terminals of the n S/H circuits 14, and a multiplexer (MUX) 15 for sequentially supplying outputs of the n S/H circuits 14 to one Analog-to-Digital (ADC) 16 according to control of the shifter register 18. The MUX 15 includes n selective switches SS1 to SSn which are individually connected to output terminals of the n S/H circuits 14 and are commonly connected to an input terminal of the ADC 16.

Although the data driver 10 further includes n output buffers connected between the n DACs 12 and the n first switches SW1 per channel, and a first shift register and a latch for sequentially inputting input data and simultaneously outputting the input data to the n DACs 12, they have the same configuration as a conventional data driver. Therefore, a description thereof will be omitted for convenience of description.

The n DACs 12 convert input data into data voltages in the display mode and the sensing mode and supply the data voltages to the n output channels CH1 to CHn through the n first switches SW1 per channel.

The n S/H circuits 14 sample and hold voltages corresponding to pixel currents through the second switches SW2 and the capacitors Ch from the n output channels CH1 to CHn in the sensing mode, respectively.

The shift register 18 sequentially outputs sampling signals to the n selective switches SS1 to SSn of the MUX 15 while performing a shift operation in response to a clock from the exterior in the sensing mode.

The n selective switches SS1 to SSn of the MUX 15 are sequentially turned on in response to the sampling signals from the shift register 18, thereby sequentially (per channel) supplying voltages held in the n S/H circuits 14, i.e. sensing voltages, to the ADC 16.

The ADC 16 converts the sensing voltages from the S/H circuits 14, which are sequentially input through the MUX 15, into digital data and outputs the digital data to a timing controller for calculating an offset value and a gain value.

The timing controller detects a pixel current based on the sensing voltage generated from the ADC 16, calculates an offset value and a gain value based on the detected pixel current, and stores the offset value and gain value in a memory. The timing controller compensates for data using the offset value and gain value stored in the memory in the display mode and outputs the compensated data to the data driver 10.

Figure 11A:
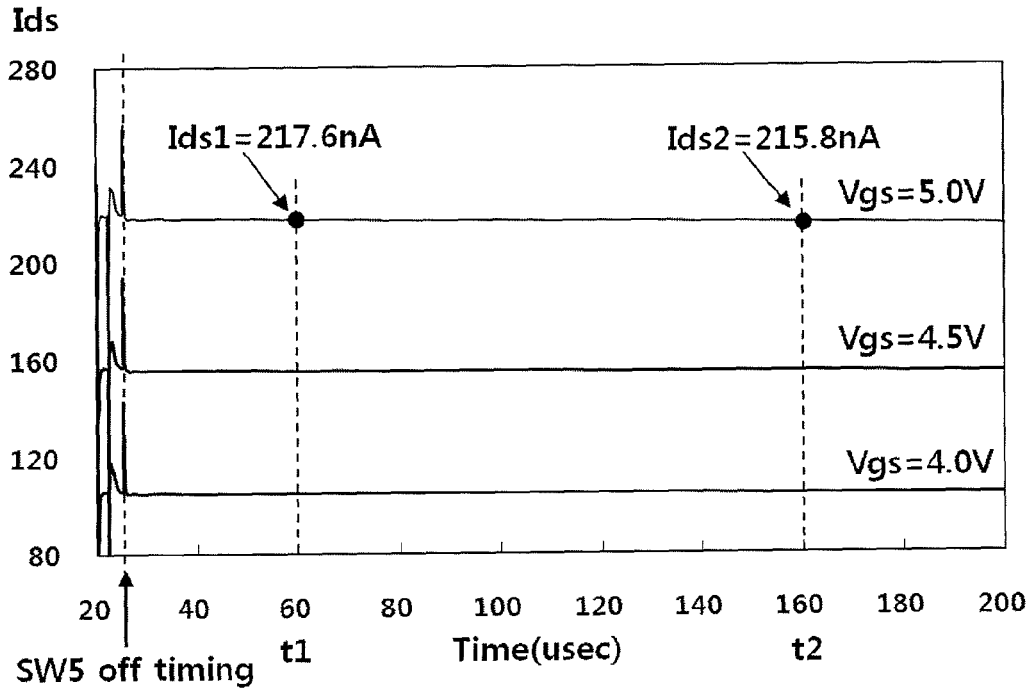
FIGS. 11A and 11B are waveform charts illustrated through simulation of the relationship between a pixel current and a sensing voltage in a sensing mode of the OLED display device illustrated in FIG. 4B.

FIG. 11A illustrates a waveform of current flowing to the driving TFT DT after the fifth switch SW5 is turned off in the sensing mode of the OLED display device illustrated in FIG. 4B. In FIG. 11A, three current waveforms are shown in the case where three driving voltage Vgs are 4V, 4.5V, and 5V. Currents are slightly changed according to a drain-source voltage Vds of the driving TFT DT by an influence of channel length modulation in a saturation region of the driving TFT DT. For example, when the driving voltage Vgs is 5V, currents at t1 and t2 are 217.6 nA and 215.8 nA, respectively, and an average current is 216.7 nA.

Figure 11B:
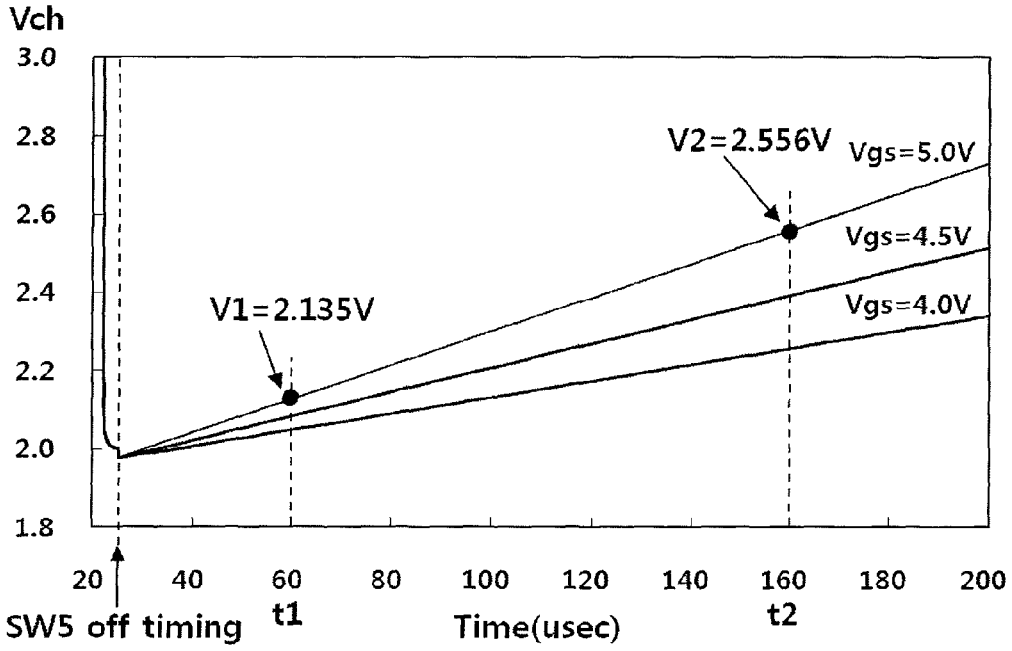

FIG. 11B illustrates input waveforms of the S/H circuit 14 after the fifth switch SW5 is turned off in the sensing mode of the OLED display device illustrated in FIG. 4B. In FIG. 11B, when Cline+Ch=50.3 pF and the driving voltage Vgs is 5V, a current of 216.6 nA ($I=(Cline+Ch)\times(V2-V1)/(t2-t1)=50.3\times 10^{12}\times(2.566-2.135)/(160-60)\times 10^{-6}=216.6$ nA) is calculated from voltage values (V1=2.235V and V2=2.556V) at t1(60 μs) and t2(160 μs). Since a drain-source voltage Vds may be expressed as Vds=Vdd−Vs≈Vdd−VCh (where VCh is an input voltage of the S/H circuit 14), Vds between t1 and t2 is changed to Vds2=Vdd−V2 from Vds1=Vdd−V1 and Vds when an average current of 216.8 nA flows is within the range of Vds2<Vds<Vds1. When Vds1≈Vds2 and an average voltage Vds_avis (Vds1+Vds2)/2, it can be appreciated that an average currentIds_av of 216.2 nA flows.

In this way, a pixel current sensing apparatus of the OLED display device according to the first and second exemplary embodiments of the present invention uses the reference line or the data line as a current sensing line in the sensing mode so as to charge the capacitors Cline and Ch connected in parallel with the current sensing line by causing a pixel current to flow the capacitors and samples and holds the voltage charged to the capacitors, thereby sequentially sensing the pixel current flowing to the driving TFT at high speed.

Figure 12:
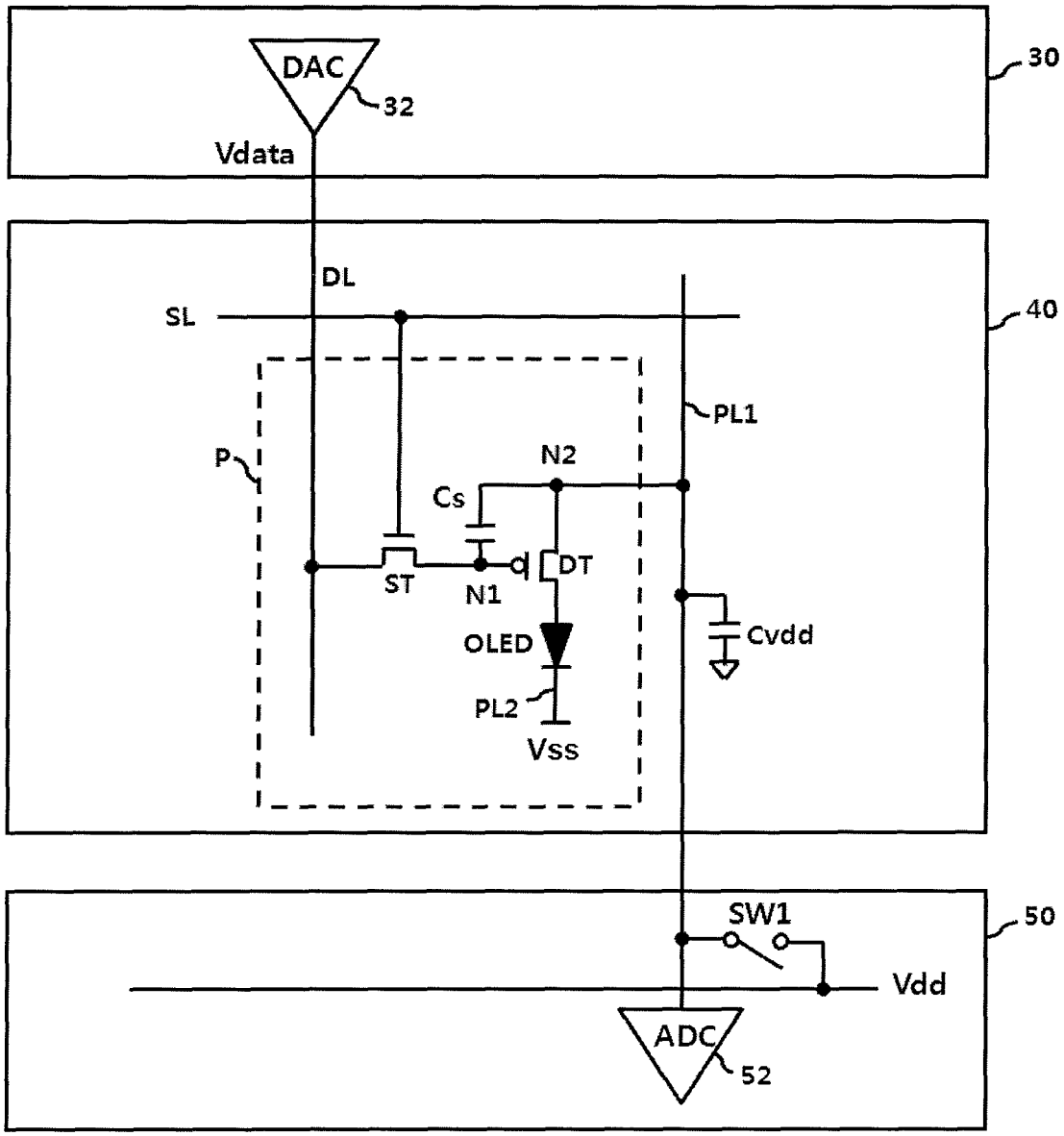
FIG. 12 is a circuit diagram illustrating a partial configuration of an OLED display device for pixel current sensing according to a third exemplary embodiment of the present invention.
Figure 13:
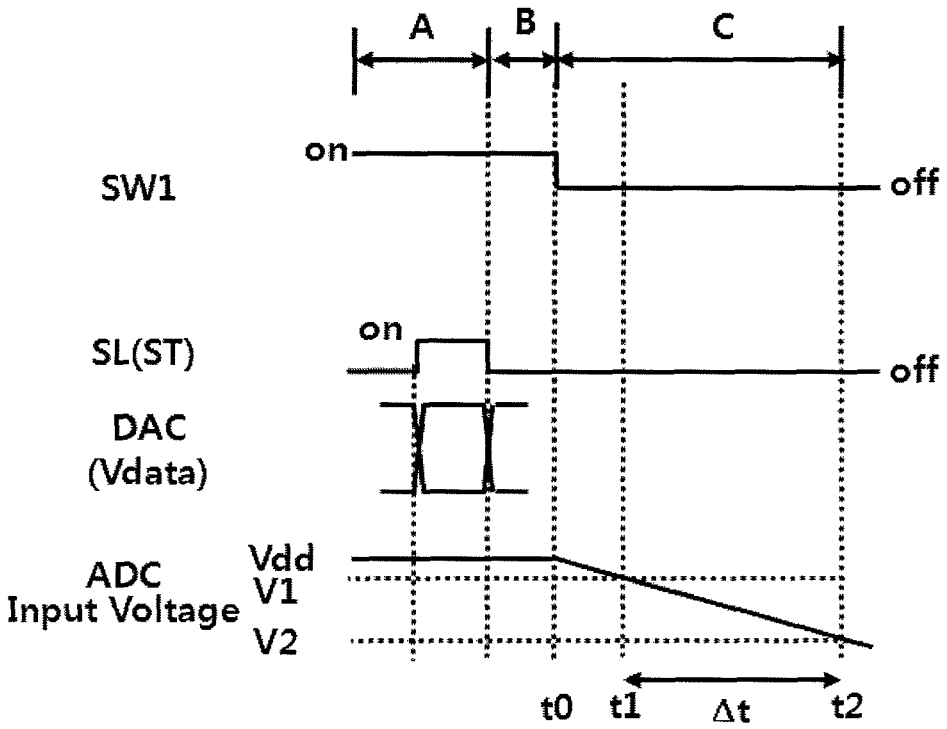
FIG. 13 is a driving waveform chart in a sensing mode of the OLED display device illustrated in FIG. 12.

FIG. 12 is an equivalent circuit diagram illustrating a partial configuration of an OLED display device for pixel current sensing according to a third exemplary embodiment of the present invention. FIG. 13 is a driving waveform chart in a sensing mode of the OLED display device illustrated in FIG. 12.

The OLED display device illustrated in FIG. 12 is different from the OLED display device of the first exemplary embodiment illustrated in FIG. 1 in that a sensing unit 50 measures a voltage corresponding to a current of each pixel P through a first power line PL1 formed in parallel with a data line DL in a display panel 40.

The OLED display device illustrated in FIG. 12 includes the display panel 40 including a pixel array, a data driver 30 for driving the data line DL of the display panel 40 in a display mode and a sensing mode, and the sensing unit 50 for supplying the high-potential voltage Vdd to the first power line PL1 of the display panel 40 in the display mode and the sensing mode and sensing a voltage corresponding to a current of each pixel through the first power line PL1 in the sensing mode. Although the OLED display device further includes a scan driver and a timing controller, they have the same configuration as a conventional configuration and, therefore, a description thereof is omitted for convenience of description.

The data driver 30 converts input data into a data voltage Vdata through a DAC 32 and supplies the data voltage Vdata to the data line. The DAC 32 is connected to the data line DLin the display mode and sensing mode.

The sensing unit 50 supplies the high-potential voltage Vdd to the first power line PL1 through a first switch SW1 in the display mode and sensing mode. The sensing unit 50 turns off the first switch SW1 in a sensing duration of the sensing mode and measures a driving current of a driving TFT DT of each pixel P through the first power line PL1, i.e. measures a voltage descending according to the pixel current through an ADC 52. The ADC 52 is connected to the first power line PL1.

A pixel circuit of each pixel P shown in FIG. 12 includes an n-type switching TFT ST for supplying the data voltage Vdata from the data line DL to a first node Ni in response to a scan signal of a scan line SL, a p-type driving TFT DT having a gate electrode connected to the first node N1 and a source electrode and a drain electrode connected respectively to the first power line PL1 and an OLED, and a storage capacitor Cs connected between a second node to which the first power line PL1 and the source electrode of the driving TFT DT are commonly connected and the first node N1. The first power line PL1 is arranged in parallel with the data line DL and the pixel P is arranged between the data line DL and the first power line PL1. The number of first power lines PL1 is the same as the number of data lines DL.

In the display mode, if the n-type switching TFT ST is turned on in response to the scan signal of the scan line SL, the storage capacitor Cs charges the difference voltage Vdata−Vdd between the data voltage Vdata supplied from the data line DL through the switching TFT ST and the high-potential voltage Vdd supplied to the first power line PL1 to drive the p-type driving TFT DT. Then, the OLED emits light in proportion to the driving current of the driving TFT DT.

Referring to FIG. 13, in a data supply duration A of the sensing mode, the first switch SW1 is turned on in response to a corresponding control signal and connects the high-potential voltage Vdd to the first power line PL1. The DAC 32 supplies the sensing data voltage Vdata to the data line DL. Next, the switching TFT ST of the pixel circuit supplies the sensing voltage Vdata to the first node N1 in response to a gate-on voltage which is the scan signal of the scan line SL. Then, the storage capacitor Cs drives the p-type driving TFT DT by charging the difference voltage Vdata−Vdd between the sensing data voltage Vdata supplied from the data line DL through the switching TFT ST and the high-potential voltage Vdd supplied to the first power line PL1.

Next, in a duration B between the data supply duration A and a sensing duration C of the sensing mode, the switching TFT ST is turned off in response to a gate-off voltage which is the scan signal of the scan line SL before the first switch SW1 is turned off and the storage capacitor Cs drives the driving TFT DT by maintaining the charge voltage Vdata−Vdd. In this case, since the first switch SW1 maintains the turned-on state, supply of the high-potential voltage Vdd to the first power line PL1 is maintained.

Figure 14:
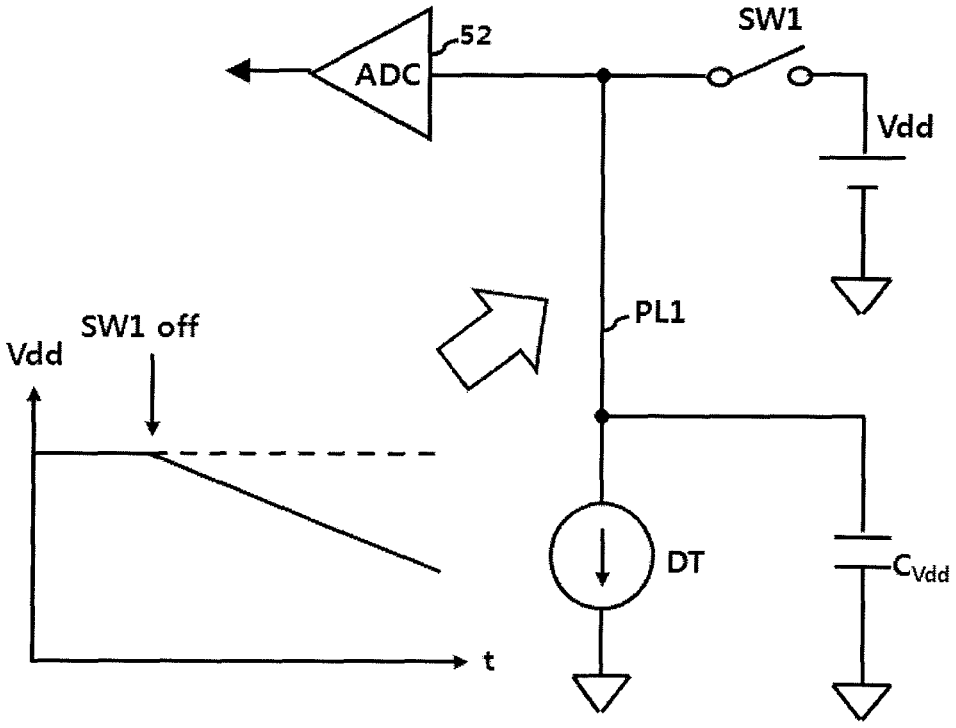
FIG. 14 is an equivalent circuit diagram of the OLED display device illustrated in FIG. 12 in a sensing duration of the sensing mode illustrated in FIG. 13.

Next, in the sensing duration C illustrated in FIG. 13, the first switch SW1 is turned off in response to a corresponding control signal and thus the high-potential voltage Vdd is not supplied to the first power line PL1. Then, current from a parasitic capacitor Cvdd connected in parallel with the first power line PL1 flows through the driving TFT DT of the pixel circuit without supply of a current from the high-potential voltage Vdd and the voltage of the first power line PL1 is linearly decreased. FIG. 14 is an equivalent circuit diagram for a path along which a pixel current flows in the sensing duration C illustrated in FIG. 13. If the first switch SW1 is turned off, a current from the parasitic capacitor Cvdd of the first power line PL1 flows to the driving TFT DT and the voltage of the first power line PL1 is lowered.

In this case, since the voltage of the first power line PL1 is lowered as the pixel current is discharged, the pixel current flowing to the driving TFT DT can be calculated using the following Equation 3 by reading the voltage of the first power line PL1 at specific times t1 and t2 through the ADC 52.

$$I=Cvdd\times(V1-V2)/(t2-t1) \quad \text{<Equation 3>}$$

In Equation 3, I denotes a pixel current, Cvdd denotes the capacitance of the parasitic capacitor Cvdd connected in parallel with the first power line PL1, and V1 and V2 denote voltages of the first power lines PL1 detected at times t1 and t2 in the duration C of the sensing mode shown in FIG. 13.

Meanwhile, if the voltage Vdd of the first power line PL1 at a start time t0 of a discharge duration is used, the pixel current I can be obtained using the following Equation 4 by sensing the voltage V2 of the first power line PL1 at a time t2 only once.

$$I=Cvdd\times(Vdd-V2)/(t2-t0) \quad \text{<Equation 4>}$$

Thus, the ADC 52 of the sensing unit 50 measures a voltage corresponding to a current of each pixel through the first power line PL1 in the sensing mode and outputs the pixel current to a timing controller.

Figure 15:
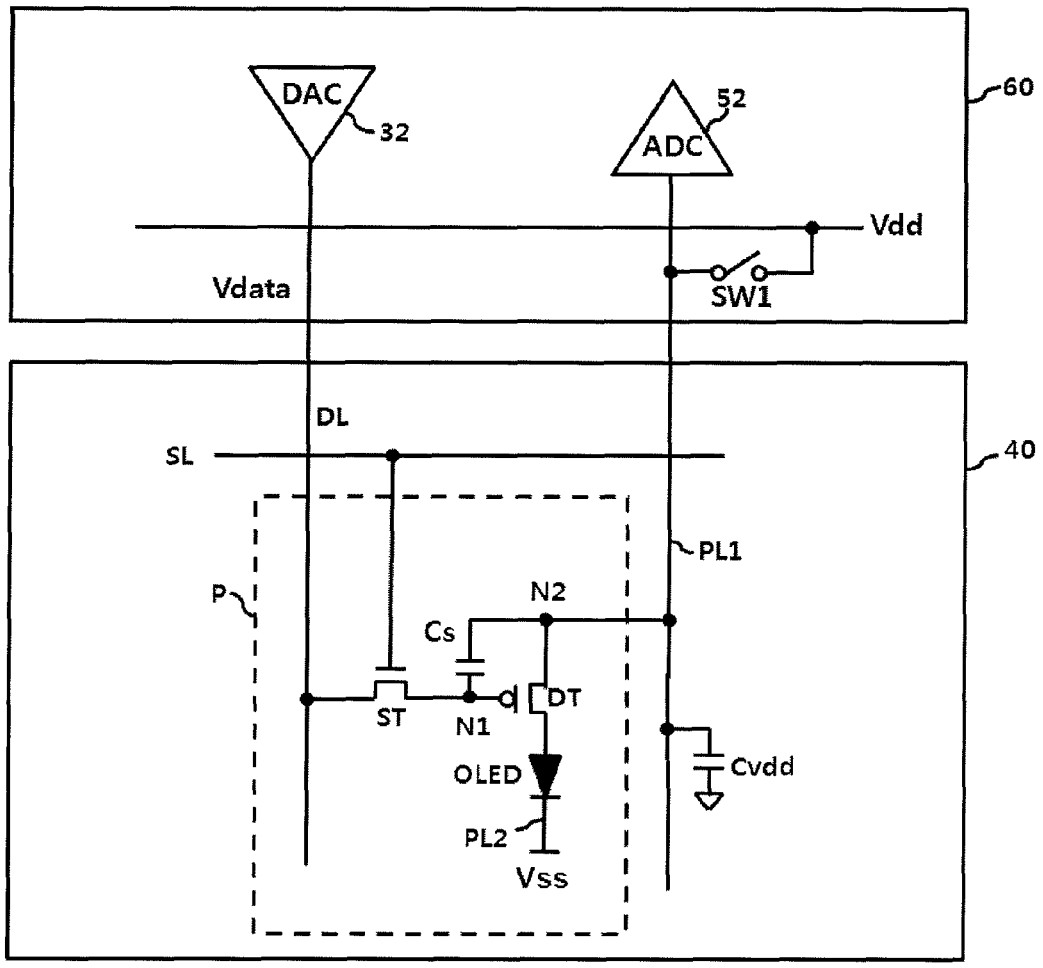
FIG. 15 is a circuit diagram illustrating a partial configuration of an OLED display device for pixel current sensing according to a fourth exemplary embodiment of the present invention.

FIG. 15 is a circuit diagram illustrating a partial configuration of an OLED display device for pixel current sensing according to a fourth exemplary embodiment of the present invention.

Since the OLED display device according to the fourth exemplary embodiment of the present invention illustrated in FIG. 15 includes the same elements as the OLED display device of the third exemplary embodiment illustrated in FIG. 12 except that the sensing unit 50 is included in a data driver 60, a description of a repeated elements will be omitted.

Referring to FIG. 15, the data driver 60 drives the data line DL of the display panel 40 through the DAC 32 in the display mode and the sensing mode and supplies the high-potential voltage Vdd to the first power line PL1 through the first switch SW1. The data driver 60 turns off the first switch SW1 in the sensing duration C of the sensing mode and measures a voltage on the first power line PL1 through an ADC 52, thereby outputting the pixel current of the pixel P corresponding to the sensing voltage. In the display panel 40, the number of data lines DL is the same as the number of first power lines PL1, the DAC 32 is connected to the data line DL per channel, and the ADC 52 is connected to the first power line PL1 per channel.

Figure 16:
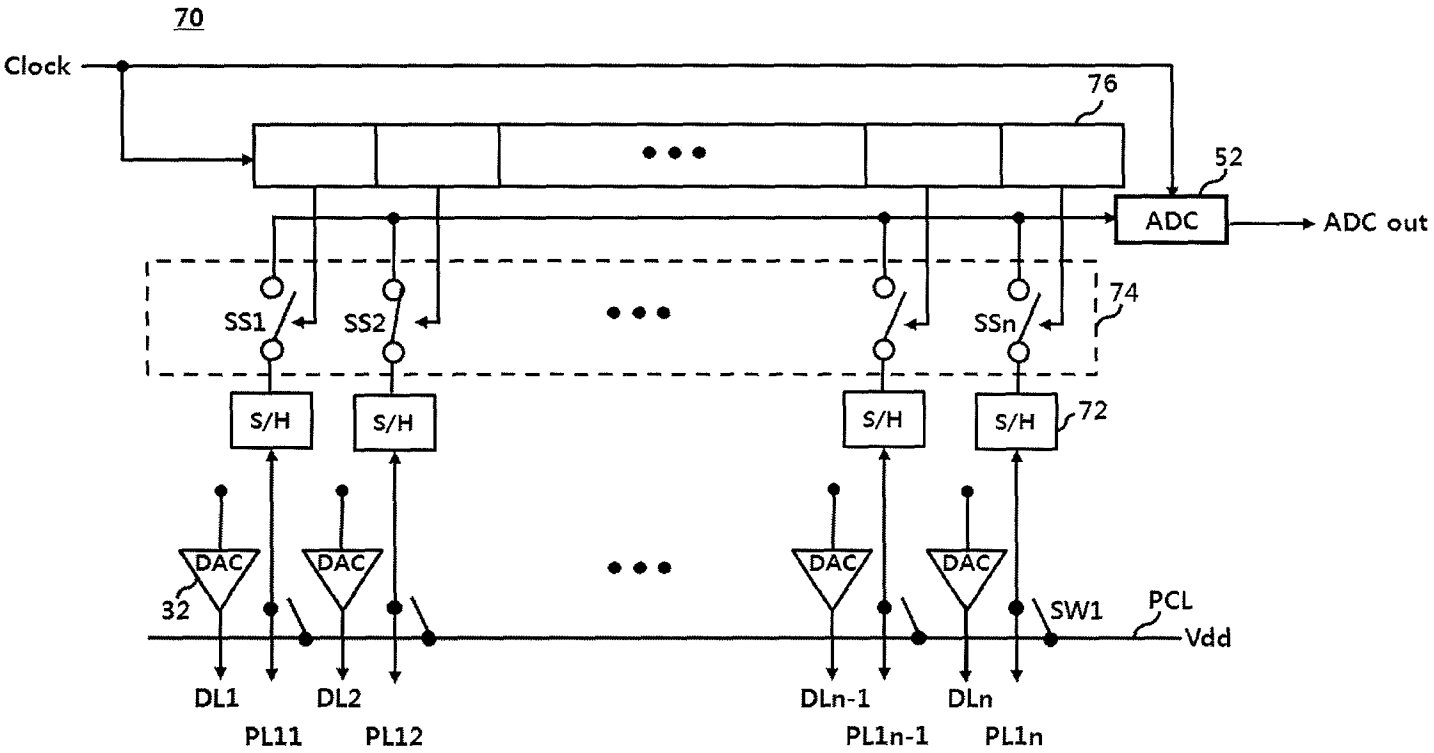
FIG. 16 is a block diagram illustrating the internal configuration of a data driver according to another exemplary embodiment of the present invention.

FIG. 16 is a block diagram illustrating the configuration of a data driver according to another exemplary embodiment of the present invention.

A data driver 70 illustrated in FIG. 16 may be applied instead of the data driver 60 illustrated in FIG. 15. The data driver 70 illustrated in FIG. 16 includes n DACs 32 connected to n data lines DL1 to DLn per channel, n first switches SW1 connected commonly to a high-potential voltage common line PCL and connected to n first power lines PL11 to PL1*n* per channel, n S/H circuits 72 connected to the n first power lines PL11 to PL1*n* per channel, a MUX 74 including a selective switches SS1 to SSn for sequentially outputting the outputs of the n S/H circuits 72 to one ADC 52, and a shift register 76 for controlling order of the outputs of the S/H circuits 72 through the MUX 74. Each of the n S/H circuits 72 includes the switch SW2 and the capacitor Ch as shown in FIG. 10.

Although the data driver 70 further includes n output buffers connected individually between the n DACs 12 and the n first switches SW1, and a first shift register and a latch for sequentially inputting input data and simultaneously outputting the input data to the n DACs 12, they have the same configuration as a conventional data driver. Therefore, a description thereof will be omitted for convenience of description.

The n DACs convert input data into data voltages and supply the data voltages to the n data lines DL1 to DLn in the display mode and the sensing mode.

The n first switches SW1 are turned on in the display mode and in the durations A and B of the sensing mode (FIG. 13) to supply the high-potential voltage Vdd to the n first power lines PL11 to PL1*n* and are turned off in the duration C (voltage sensing duration) of the sensing mode to float the n first power lines PL11 to PL1*n* to be separated from one another per channel.

The n S/H circuits 72 sample and hold voltages corresponding to pixel currents supplied from the n first power lines PL11 to PL1*n* in the duration C of the sensing mode (FIG. 13).

The shift register 76 outputs sequential sampling signals to the n selective switches SS1 to SSn of the MUX 74 while performing a shift operation in response to a clock from the exterior in the sensing mode.

The n selective switches SS1 to SSn of the MUX 74 are sequentially turned on in response to the sampling signals from the shift register 76 to sequentially (per channel) supply voltages sampled and held in the n S/H circuits 72, i.e. sensing voltages, to the ADC 52.

The ADC 52 converts the sensing voltages which are sequentially input through the MUX 74 from the S/H circuit 72 into digital data and outputs the digital data to the timing controller for calculating an offset value and a gain value.

The timing controller detects a pixel current based on the sensing voltage output from the ADC 52 in the sensing mode, calculates the offset value and the gain value using the detected pixel current, and stores the offset value and the gain value in a memory. The timing controller compensates for data using the offset value and the gain value stored in the memory and outputs the compensated data to the data driver 70.

Figure 17:
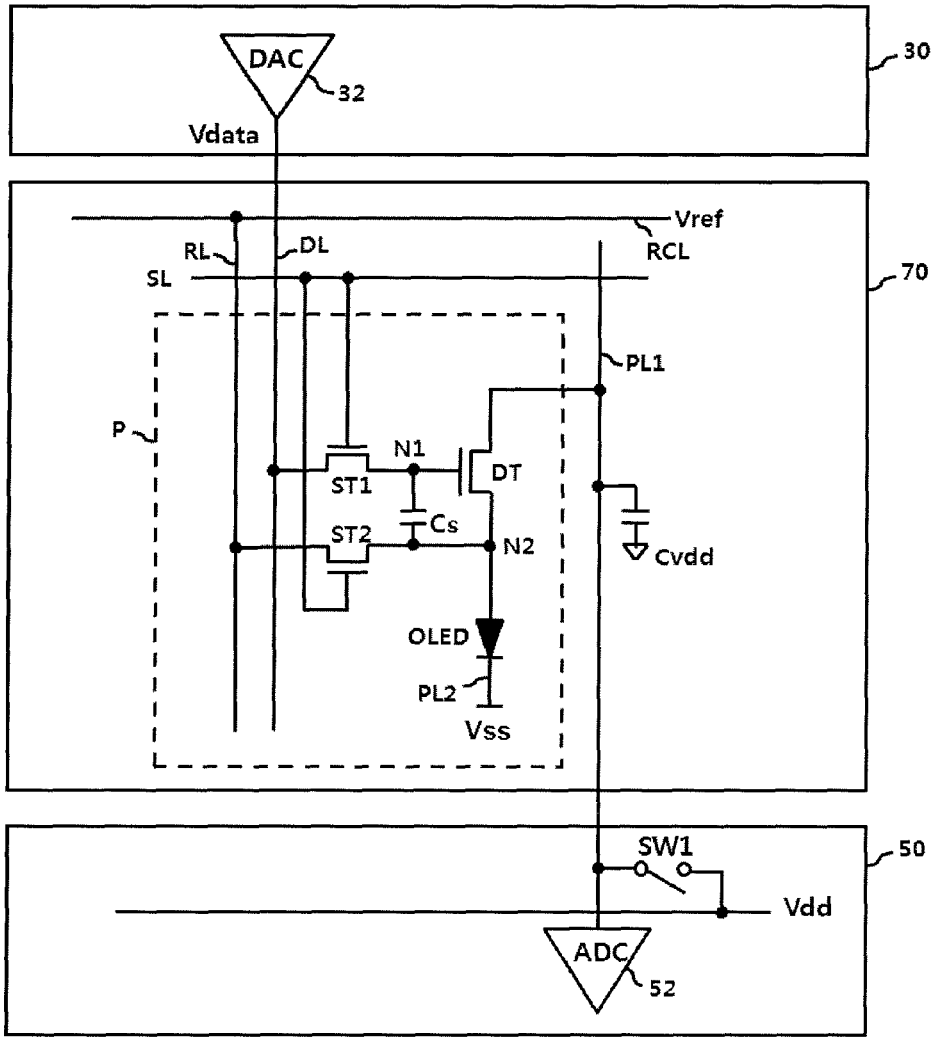
FIG. 17 is a circuit diagram illustrating a partial configuration of an OLED display device for pixel current sensing according to a fifth exemplary embodiment of the present invention.

FIG. 17 is a circuit diagram illustrating a partial configuration of an OLED display device for pixel current sensing according to a fifth exemplary embodiment of the present invention.

The OLED display device according to the fifth exemplary embodiment illustrated in FIG. 17 includes the same elements as the OLED display device according to the third exemplary embodiment illustrated in FIG. 12 except that a display panel 70 further includes a reference line RL connected to a pixel P and arranged in parallel with a data line DL, a reference common line RCL to which a plurality of reference lines RL is commonly connected, and a second switching TFT ST2 for sharing the same scan line SL with the first switching TFT ST1 to supply a reference voltage Vref from the reference line RL to a second node N2, and the driving TFT DT is an n-type which is the same as the type of the first and second switching TFTs ST1 and ST2. Therefore, a description of repeated elements will be omitted. The sensing unit 50 illustrated in FIG. 17 may be integrated with the data driver 30 as shown in FIG. 15.

Referring to FIG. 17, the first and second switching TFTs are turned on in a corresponding scan duration of a display mode and the storage capacitor Cs charges the difference voltage Vdata−Vref between the data voltage Vdata and the reference voltage Vref to drive the driving TFT DT.

In a sensing mode, the driving waveform of the third exemplary embodiment illustrated in FIG. 13 is identically applied to the OLED display device according to the fifth exemplary embodiment illustrated in FIG. 17.

Referring to FIGS. 17 and 13, the first and second switching TFTs ST1 and ST2 are simultaneously turned on in response to a gate-on voltage which is a scan signal of the scan line in the data supply duration A of the sensing mode and the storage capacitor Cs drives the driving TFT DT by charging the difference voltage Vdata−Vref between the sensing data voltage Vdata from the first switching TFT ST1 and the reference voltage Vref from the second switching TFT ST2.

Next, the first and second switching TFTs ST1 and ST2 are turned off in response to a gate-off voltage which is a scan signal of the scan line SL in the duration B (FIG. 13) and the storage capacitor Cs maintains the charge voltage Vdata−Vref to drive the driving TFT DT. In this case, the first switch SW1 maintains the turned-on state and supply of the high-potential voltage Vdd to the first power line PL1 is maintained.

In the sensing duration C (FIG. 13), the first switch SW1 is turned off and a current from the parasitic capacitor Cvdd connected in parallel with the first power line PL1 flows through the driving TFT DT of the pixel circuit without supply of a current from the high-potential voltage Vdd to linearly lower the voltage of the first power line PL1. Then, a pixel current flowing to the driving TFT DT can be calculated using the above-described Equation 3 or 4 by sensing the voltage of the first power line PL1 at specific times t1 and t2 through the ADC 52.

Figure 18:
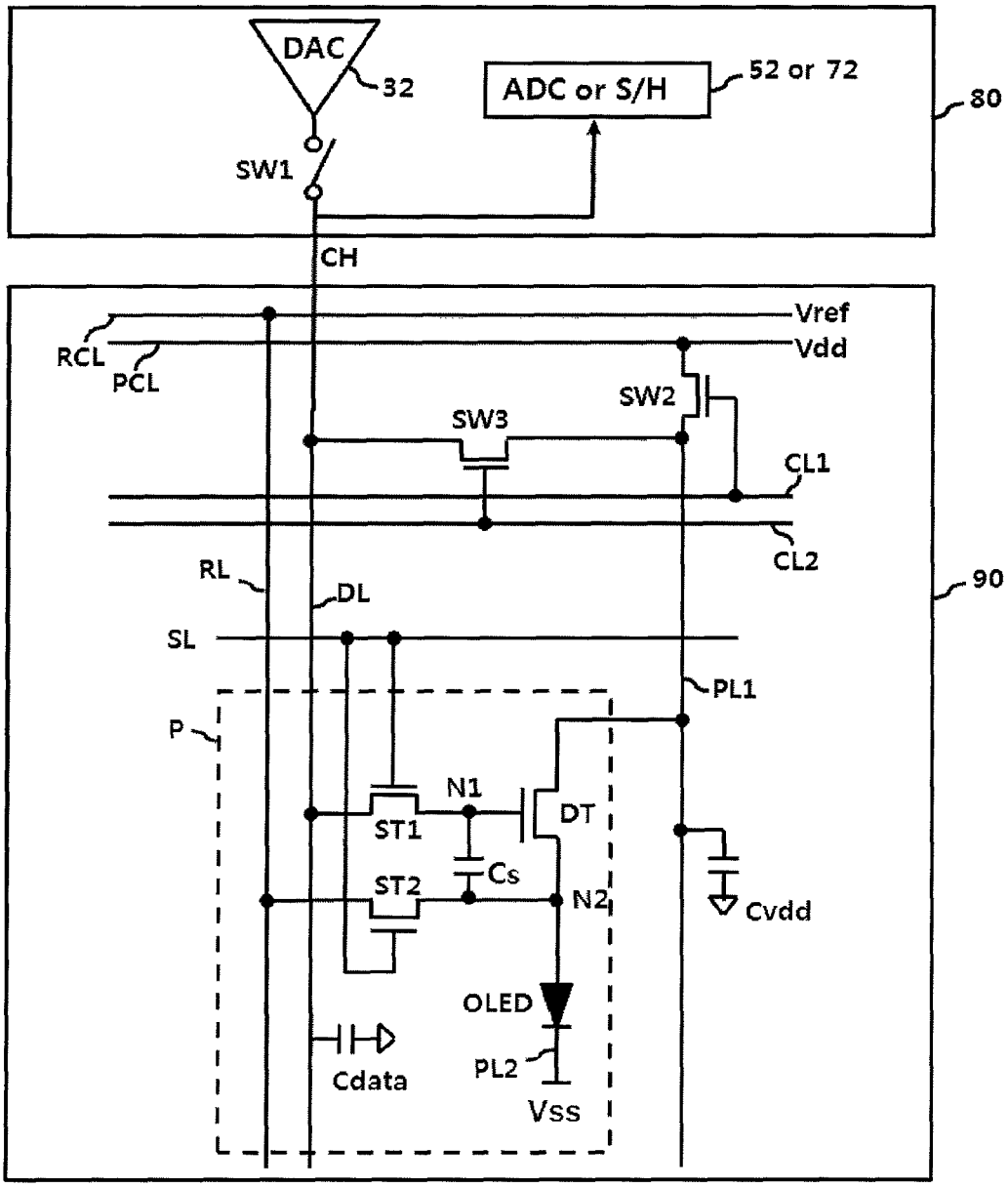
FIG. 18 is a circuit diagram illustrating a partial configuration of an OLED display device for pixel current sensing according to a sixth exemplary embodiment of the present invention.
Figure 19:
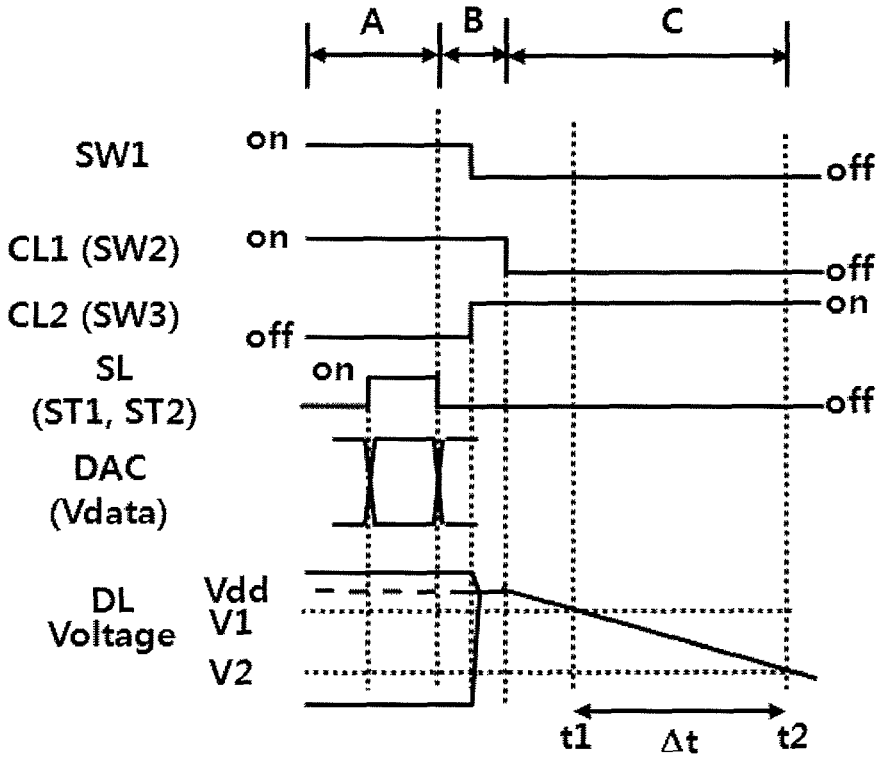
FIG. 19 is a driving waveform chart of a sensing mode of the OLED display device illustrated in FIG. 18.

FIG. 18 is a circuit diagram illustrating a partial configuration of an OLED display device for pixel current sensing according to a sixth exemplary embodiment of the present invention. FIG. 19 is a driving waveform chart of the OLED display device illustrated in FIG. 18.

The OLED display device according to the sixth exemplary embodiment illustrated in FIG. 18 includes the same elements as the OLED display device according to the fifth exemplary embodiment illustrated in FIG. 15 except for the ADC 52 or S/H circuit 72 included in a data driver 80 shares the output channel CH with the DAC 32 and a display panel 90 includes a second switch SW2 connected between a high-potential common line PCL and the first power line PL1, a third switch SW3 connected to the data line and the first power line PL1, and control lines CL1 and CL2 for respectively controlling the second and third switches SW2 and SW3. Therefore, a description of repeated elements will be omitted.

In a data driver 80 shown in FIG. 18, the DAC 32 is connected to the output channel CH connected to the data line DL through the first switch SW1 per channel. The ADC 52 or the S/H circuit 72 is connected to the output channel CH in parallel with the DAC 32 and shares the output channel CH with the DAC 32. The ADC 52 or the S/H circuit 72 is connected to the first power line PL1 through the output channel CH and the data line DL in a sensing mode. Accordingly, even though the data driver 80 includes a sensing circuit including the ADC 52 or the S/H circuit 72, the number of output channels of the data driver 80 can be maintained identically to the number of data lines DL.

In addition to the pixel P shown in FIG. 17, a display panel 90 shown in FIG. 18 includes the reference common line RCL for supplying the reference voltage Vref from the exterior to the reference line RL arranged in parallel with the data line DL, the high-potential common line PCL for supplying the high-potential voltage Vdd from the exterior to the first power line PL1 arranged in parallel with the data line DL, the second switch SW2 connected between the high-potential common line PCL and the first power line PL1 per channel, the third switch SW3 connected between the first power line PL1 and the data line DL, and first and second control lines CL1 and CL2 for respectively controlling the second and third switches SW2 and SW3.

The second switch SW2 is turned on in a display mode in response to a first control signal from the first control line CL1 and is turned on in supply duration A of the high-potential voltage Vdd and precharge duration B in a sensing mode shown in FIG. 19 to supply the high-potential voltage Vdd from the high-potential common line PCL to the first power line PL1. The second switch SW2 is turned off in a sensing duration C to cut off supply of the high-potential voltage Vdd.

The third switch SW3 is turned off in the display mode in response to a second control signal from the second control line CL2 and is turned off in the supply duration A of the high-potential voltage Vdd of the sensing mode shown in FIG. 19. The third switch SW3 is turned on in a precharge duration B and sensing duration C of the sensing mode to connect the first power line PL1 to the data line DLper channel. The third switch SW3 is turned on before the second switch SW2 is turned off in order to precharge the data line DL to the high-potential voltage Vdd prior to the sensing duration C.

Referring to FIG. 18, in the display mode, the first switch SW1 of the data driver 80 and the second switch SW2 of the display panel 90 are turned on and the third switch SW3 is turned off. The first and second switching TFTs ST1 and ST2 are turned on in a corresponding scan duration during which a gate-on voltage is supplied to the scan line SL and the storage capacitor Cs charges the difference voltage Vdata−Vref between the data voltage Vdata and the reference voltage Vref to drive the driving TFT DT.

Referring to FIGS. 18 and 19, in the data supply duration A of the sensing mode, the first switch SW1 of the data driver 80 and the second switch SW2 of the display panel 90 are turned on and the third switch SW3 is turned off. The first and second switching TFTs ST1 and ST2 are turned on in a corresponding scan duration during which a gate-on voltage is supplied to the scan line SL and the storage capacitor Cs charges the difference voltage Vdata−Vref between the sensing data voltage Vdata from the first switching TFT ST1 and the reference voltage Vref from the second switching TFT ST2 to drive the driving TFT DT.

In the precharge duration B shown in FIG. 19, the first and second switching TFT ST1 and ST2 are turned off in response to a gate-off voltage of the scan line SL and the storage capacitor Cs maintains the charge voltage Vdata−Vref to drive the driving TFT DT. The second switch SW2 maintains the turned-on state in the precharge duration B to maintain supply of the high-potential voltage Vdd to the first power line PL. The third switch SW3 is turned on at a middle point of the duration B to precharge the high-potential voltage Vdd which is the same as a voltage of the first power line PL1 to the data line DL. In this case, the first switch SW1 is turned off at a middle point of the precharge duration B as opposed to the third switch SW3 to electrically separate the DAC 32 from the data line DL when the high-potential voltage Vdd is precharged to the data line DL.

In the sensing interval C shown in FIG. 19, the first switch SW1 maintains the turned-off state and the second switch SW2 is turned off by a gate-off voltage. Accordingly, a current from the parasitic capacitors Cvdd and Cdata connected in parallel with the first power line PL1 and the data line DL flows through the driving TFT DT of the pixel circuit without supply of the high-potential voltage Vdd and the voltages of the first power line PL1 and the data line DL are linearly lowered according to the pixel current. Then, the voltages of the first power line PL1 at specific times t1 and t2 are sensed in the ADC 52 through the data line DL and the output channel CH.

A timing controller can calculate the pixel current flowing to the driving TFT DT using sensing voltages V2 and V1 from the data driver 80 and the following Equation 5.

$$I=(\text{Cdata}+Cvdd)\times(V1-V2)/(t2-t1) \quad \text{<Equation 5>}$$

In Equation 5, I denotes a pixel current, Cdata denotes the capacitance of the parasitic capacitor Cdata connected in parallel with the data line DL, Cvdd denotes the capacitance of the parasitic capacitor Cvdd connected in parallel with the first power line PL1, and V1 and V2 denote voltages of the output channel CH detected at times t1 and t2 in the duration C of the sensing mode shown in FIG. 19.

Figure 20A:
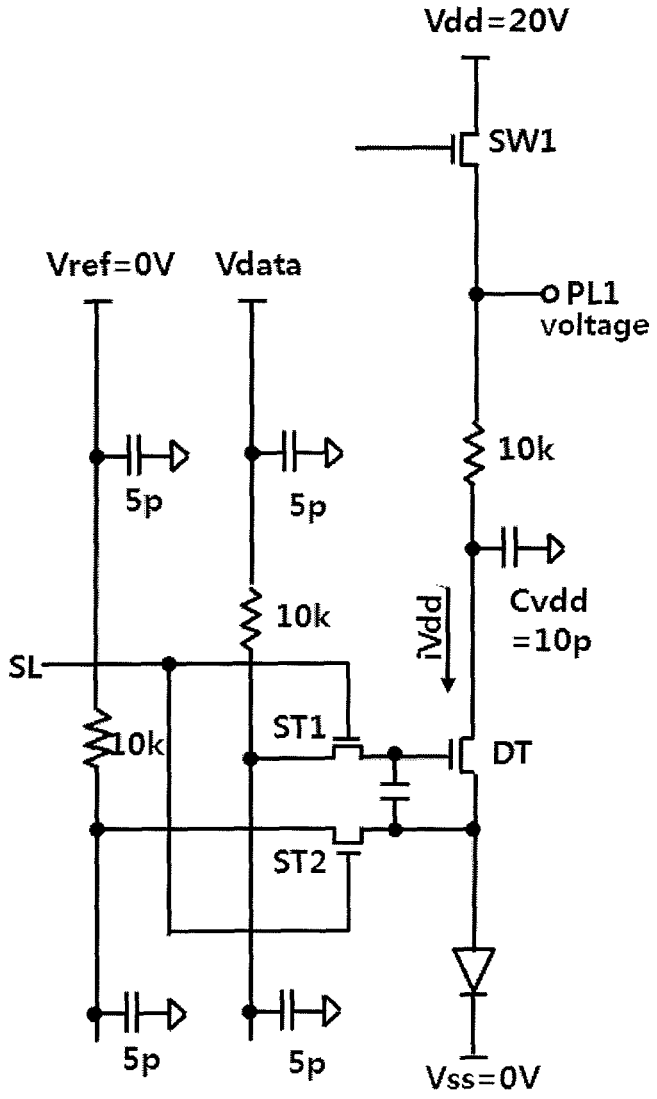
FIGS. 20A to 20C are an equivalent circuit diagram obtained by simulating the OLED display device illustrated in FIG. 17 and diagrams illustrating voltages and currents sensing through a first power line of the equivalent circuit diagram.
Figure 20B:
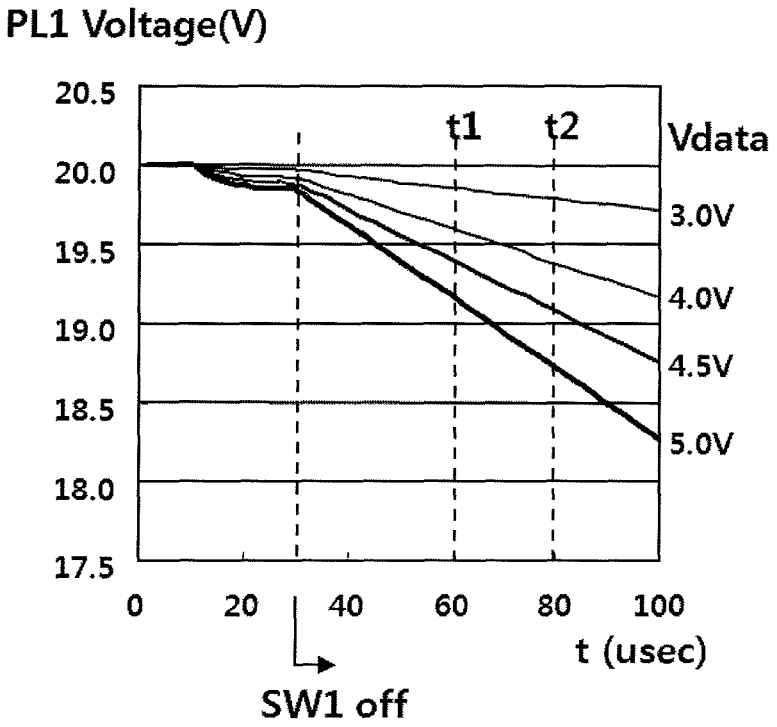
Figure 20C:
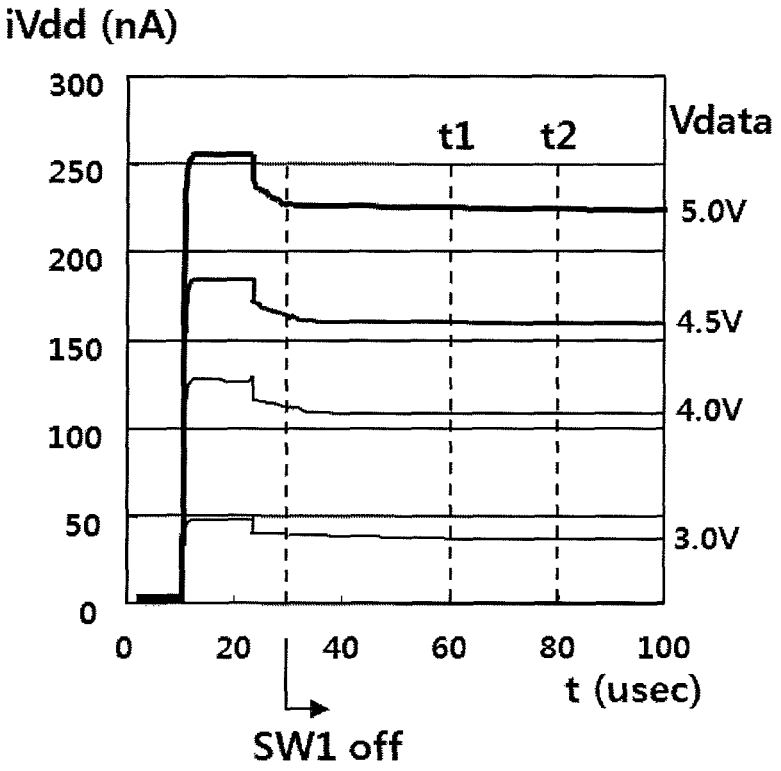

FIG. 20A is an equivalent circuit diagram for simulating the OLED display device for pixel current sensing of the present invention. FIG. 20B illustrates a waveform chart of sensing voltages of a first power line PL1 after the first switch SW1 is turned off in FIG. 20A and currents calculated from the sensing voltages. FIG. 20C is a waveform chart illustrating currents flowing to the driving TFT DT of FIG. 20A in a sensing mode.

In FIGS. 20B and 20C, four voltage waveforms and four current waveforms are illustrated when the data voltage Vdata is 3V, 4V, 4.5V, and 5V.

In FIG. 20B, when the data voltage Vdata is 3V, 4V, 4.5V, and 5V, currents calculated using voltages sensed at t1 (=60 μsec) and t2(=80 μsec) and the above-described Equation 5 (Cvdd=10 pF) are 36.82 nA, 108.16 nA, 160.52 nA, and 224.49 nA.

In FIG. 20C, when the data voltage Vdata is 3V, 4V, 4.5V, and 5V, average values of currents calculated using current sensed directly at t1 (=60 μsec) and t2(=80 μsec) are 36.83 nA, 108.15 nA, 160.48 nA, and 224.51 nA.

Accordingly, since the pixel currents calculated by sensing the voltage of the first power line PL1 in FIG. 20B have an error within 0.1% compared with the average pixel currents sensed directly in FIG. 10C, it can be appreciated that a comparatively accurate pixel current can be sensed.

In this way, the OLED display device for pixel current sensing and the pixel current sensing method thereof according to the present invention can sequentially sense a pixel current at high speed by sensing a voltage corresponding to the pixel current flowing into a driving TFT through a first power line arranged in parallel with a data line in a sensing mode.

In addition, the OLED display device for pixel current sensing and the pixel current sensing method thereof according to the present invention can sense each pixel current at high speed by a simple configuration through a data driver. Accordingly, the present invention can sense each pixel current by including a sensing mode in a display mode in which the OLED display device is driven even after product shipment as well as a test process before product shipment, thereby compensating for a characteristic deviation caused by degradation of the driving TFT as well as an initial characteristic deviation of a driving TFT. Accordingly, the lifespan and picture quality of the OLED display device can be increased.

The OLED display device for pixel current sensing and the pixel current sensing method thereof according to the present invention charge a capacitor connected in parallel with a reference line or a data line of a display panel in a sensing mode by causing a current to the capacitor and sample and hold a voltage charged to the capacitor, thereby sequentially sensing a pixel current flowing to a driving TFT at high speed and compensating luminance non-uniformity.

The OLED display device for pixel current sensing and the pixel current sensing method thereof according to the present invention can sequentially sense a pixel current at high speed by sensing a voltage corresponding to a pixel current flowing to a driving TFT through a first power line arranged in parallel with a data line in a sensing mode.

The OLED display device for pixel current sensing and the pixel current sensing method thereof according to the present invention can sense each pixel current at high speed by a simple configuration through a data driver. Accordingly, the present invention senses each pixel current by including a sensing mode in a display mode in which the OLED display device is driven even after product shipment as well as a test process before product shipment, thereby compensating for a characteristic deviation caused by degradation of a driving TFT and increasing lifespan and picture quality of the OLED display device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An Organic Light Emitting Diode (OLED) display device for pixel current sensing, comprising:

a display panel including pixels, each of the pixels including a light emitting element and a pixel circuit for independently driving the light emitting element;

a data driver for driving a data line connected to the pixel circuit using a data voltage, floating one among the data line, a reference line for supplying a reference voltage to the pixel circuit, and a first power line for supplying a power to the pixel circuit in the display panel to use the floated line as a current sensing line, sensing a voltage corresponding to a pixel current of the pixel circuit flowing to the current sensing line, and outputting the sensing voltage, in a sensing mode; and a timing controller for calculating, in the sensing mode, the pixel current using the sensing voltage output from the data driver, a sensing duration of the sensing voltage, and a capacitance of a capacitor connected in parallel with the current sensing line, calculating a compensation value using the calculated pixel current, and storing the calculated compensation value.

2. The OLED display device of claim 1, wherein a driver of the data driver includes a digital-to-analog converter for supplying the data voltage to the data line through an output channel, and wherein a sensing unit of the data driver includes a sampling and holding circuit connected to the output channel in parallel with the digital-to-analog converter, for sampling and holding the voltage of the current sensing line and outputting the sampled and held voltage as the sensing voltage, and an analog-to-digital converter for converting the sensing voltage from the sampling and holding circuit into digital data.

3. The OLED display device of claim 2, wherein the sensing unit of the data driver further includes:

a shift register for sequentially outputting sampling signals in the sensing mode; and a multiplexer for sequentially outputting multiple outputs of the sampling and holding circuit to the analog-to-digital converter in response to the sampling signals.

4. The OLED display device of claim 2, further comprising a power switch for connecting a second power line connected to a cathode of the light emitting element to a low-potential power or a high-potential voltage, wherein the driver of the data driver further includes a first switch connected between the digital-to-analog converter and the output channel per channel, the sensing unit of the data driver further includes a second switch connected between the output channel and the sampling and holding circuit per channel, the power switch connects the low-potential power to the power line in a display mode and connects the high-potential voltage to the power line in the sensing mode, the first switch connects the digital-to-analog converter to the output channel in the display mode and in a data supply duration of the sensing mode, and the second switch connects the output channel to the sampling and holding circuit in the sensing duration of the sensing mode.

5. The OLED display device of claim 4, wherein the display panel further includes:

a third switch connected between the output channel of the data driver and the data line per channel;

a fourth switch connected between the output channel and the reference line per channel; and a fifth switch connected between a reference common line for supplying the reference voltage and the reference line per channel, wherein the third switch connects the output channel to the data line in the display mode and in the data supply duration of the sensing mode, the fourth switch connects the output channel to the reference line in the sensing duration of the sensing mode, and the fifth switch connects the reference common line to the reference line in the display mode and in the data supply duration of the sensing mode.

6. The OLED display device of claim 5, wherein the second, fourth, and fifth switches are turned on in a precharge duration between the data supply duration and the sensing duration of the sensing mode to precharge the output channel connected to the sampling and holding circuit to the reference voltage supplied from the reference line.

7. The OLED display device of claim 6, wherein the pixel circuit includes:

a driving TFT connected serially between the first and second power lines, for driving the light emitting element;

a first switching TFT for supplying a data voltage supplied from the data line to a first node connected to a gate electrode of the driving TFT in response to a first scan signal of a first scan line;

a second switching TFT for supplying the reference voltage supplied from the reference line to a second node connected between the driving TFT and the light emitting element in response to a second scan signal of a second scan line; and a storage capacitor for charging a voltage between the first and second nodes to supply the changed voltage as a driving voltage of the driving TFT, wherein the first switching TFT is turned on only in the data supply duration of the sensing mode, the second switching TFT is turned on during an interval from the data supply duration to the sensing duration of the sensing mode and the pixel current flows from the driving TFT to the reference line in the sensing duration, and the sensing unit measures a voltage ascending in proportion to the pixel current through the reference line and the output channel in the sensing duration and outputs the sensing voltage.

8. The OLED display device of claim 4, wherein the pixel circuit includes:

a driving TFT connected serially between the first and second power lines, for driving the light emitting element;

a first switching TFT for supplying the reference voltage supplied from the reference line to a first node connected to a gate electrode of the driving TFT in response to a first scan signal of a first scan line;

a second switching TFT for supplying the data voltage supplied from the data line to a second node connected between the driving TFT and the light emitting element in response to a second scan signal of a second scan line; and a storage capacitor for charging a voltage between the first and second nodes to supply the changed voltage as a driving voltage of the driving TFT, wherein the first switching TFT is turned on only in the data supply duration of the sensing mode, the second switching TFT is turned on during an interval from the data supply duration to the sensing duration of the sensing mode and the pixel current flows from the driving TFT to the data line in the sensing duration, and the sensing unit measures a voltage ascending in proportion to the pixel current through the data line and the output channel in the sensing duration.

9. The OLED display device of claim 8, wherein the first switch is turned on in a precharge duration between the data supply duration and the sensing duration of the sensing mode to supply a precharge voltage supplied from the digital-to-analog converter to the data line.

10. The OLED display device of claim 1, wherein the timing controller calculates the pixel current (I) through the following Equation 1, using sensing voltages V1 and V2 obtained by sensing voltages on the current sensing line in the data driver, sensing times t1 and t2 of the sensing voltages V1 and V2, and the capacitance C of the capacitor connected in parallel with the current sensing line:

$$I=C\times(V2-V1)/(t2-t1) \quad \text{<Equation 1>.}$$

11. A method for sensing each pixel current of an Organic Light Emitting Display (OLED) display device, the method comprising:

driving a pixel circuit by supplying a data voltage to the pixel circuit in a data supplying duration of a sensing mode;

floating one of a data line connected to the pixel circuit, a reference line, and a first power line to use the floated line as a current sensing line, in a sensing duration of the sensing mode, sensing a voltage corresponding to a pixel current of the pixel circuit flowing to the current sensing line, and outputting the sensing voltage; and calculating the pixel current using the sensing voltage, the sensing duration, and a capacitance of a capacitor connected in parallel with the current sensing line, and calculating a compensation value using the calculated pixel current, storing the compensation value, in the sensing mode.

12. The method of claim 11, wherein, in the data supply duration, the data voltage is supplied to the data line through a first switch connected between a digital-to-analog converter of a data driver and a output channel and through the output channel, and in the sensing duration, a voltage on the current sensing line is sensing through sampling and holding through a second switch which is connected to the output channel in parallel with the first switch in the data driver and performs an opposite operation to the first switch, in the sensing duration, and the sensing voltage is converted into digital data.

13. The method of claim 12, wherein, in the data supply duration, the output channel of the data driver is connected to the data line through a third switch, a fourth switch between the output channel and the reference line is turned off, and a reference voltage is supplied to the reference line through a fifth switch, and in the sensing duration, the third and fifth switches are turned off and the reference line is connected to the output channel through the fourth switch to sense a voltage corresponding to the pixel current through the reference line.

14. The method of claim 13, further comprising precharging the output channel to the reference voltage supplied from the reference line in a precharge duration between the data supply duration and the sensing duration, wherein the second, fourth, and fifth switches are turned on.

15. The method of claim 12, further comprising:

sensing a voltage corresponding to the pixel current through the second switch and the data line in the sensing duration; and turning on the first switch and supplying a precharge voltage supplied from the digital-to-analog converter to the data line, in a precharge duration between the data supply duration and the sensing duration.

16. The method of claim 11, wherein the pixel current (I) is calculated through the following Equation 1, using sensing voltages V1 and V2, sensing times t1 and t2 of the sensing voltages V1 and V2, and a capacitance C of a capacitor connected in parallel with the current sensing line:

$$I=C\times(V2-V1)/(t2-t1) \quad \text{<Equation 1>.}$$

17. An apparatus comprising:

a display panel including a plurality of pixels each having first and second switching transistors, a driving transistor and a light-emitting diode, a plurality of signal lines having a reference line for supplying a reference voltage to the pixels, a power line for supplying a power to the pixels, a data line for supplying a data voltage to the pixels, and a plurality of switches connected the signal lines; and a data driver having a driving circuit for supplying the data voltage to the pixels and a sensing circuit for sensing a voltage corresponding to a current of the pixels flowing to the reference line to use as a sensing line and outputting the sensing voltage, in a sensing mode, wherein in the sensing mode, a capacitor connected in parallel with the sensing line is charged according to the pixel current flowing through the sensing line from the pixel circuit, and the sensing unit senses the sensing voltage on the sensing line by sampling and holding the charged voltage in the capacitor and outputs the sensing voltage.

18. The apparatus of claim 17, wherein the plurality of switches comprises:

a power switch for connecting the power line connected to a cathode of the light emitting element to a low-potential power or a high-potential voltage;

a first switch for connecting the data line connected to the first switching transistor to an output channel of the data driver;

a second switch for connecting the reference line connected to the second switching transistor to the output channel of the data driver; and a third switch for connecting a reference common line for supplying the reference voltage to the pixels to the reference line.

19. The apparatus of claim 18, wherein the driving circuit comprises a digital-to-analog converter for supplying the data voltage to the data line through the output channel and a fifth switch connected between the digital-to-analog converter and the output channel.

20. The apparatus of claim 17, wherein the sensing circuit comprises a sampling and holding circuit for sensing the sensing voltage supplied through a sixth switch and the reference line and an analog-to-digital converter for converting the sensing voltage from the sampling and holding circuit into digital data.

21. The apparatus of claim 19, wherein the sensing circuit is configured to receive the sensing voltage, in the sensing mode, when the power, second, and fifth switches are turned on.

* * * * *